US005735251A

United States Patent [19]

Hyodo et al.

[11] Patent Number: 5,735,251

[45] Date of Patent: Apr. 7, 1998

[54] FUEL-VAPOR EMISSION CONTROL APPARATUS FOR ENGINE

[75] Inventors: Yoshihiko Hyodo, Susono; Takaaki Itoh, Mishima; Naoya Takagi, Susono, all of Japan

[73] Assignee: Toyota Jidosha Kabushiki Kaisha, Toyota, Japan

[21] Appl. No.: 856,418

[22] Filed: May 14, 1997

[30] Foreign Application Priority Data

May 15, 1996 [JP] Japan ..... 8-120315

[51] Int. Cl.[6] ..... F02M 33/02

[52] U.S. Cl. ..... 123/518

[58] Field of Search ..... 123/518, 519, 123/520, 198 D, 339; 73/19.05, 19.03, 118.1, 40

[56] References Cited

U.S. PATENT DOCUMENTS

| | | | |
|---|---|---|---|
| 5,146,902 | 9/1992 | Cook et al. | 123/518 |
| 5,216,991 | 6/1993 | Iida et al. | 123/339 |
| 5,228,421 | 7/1993 | Orzel | 123/339 |
| 5,426,971 | 6/1995 | Glidwell et al. | 73/19.05 |

FOREIGN PATENT DOCUMENTS

| | | | |
|---|---|---|---|
| 60-116937A | 6/1985 | Japan | 123/518 |
| 63-39457Y2 | 10/1988 | Japan | 123/518 |
| 2212222A | 8/1990 | Japan | 123/518 |
| 6241129A | 8/1994 | Japan | 123/518 |

*Primary Examiner*—Raymond A. Nelli
*Attorney, Agent, or Firm*—Kenyon & Kenyon

[57] ABSTRACT

A fuel-vapor emission control apparatus is mounted on a vehicle having an internal combustion engine and a fuel tank. The engine has a plurality of cylinders and is supported by engine mounts. The fuel-vapor emission control apparatus purges fuel-vapor in the fuel tank and supplies the purged fuel-vapor to the engine. The apparatus includes a vacuum switching valve, sensors and an electronic control unit. The vacuum switching valve controls the amount of purged fuel-vapor that is supplied to the engine. The sensors detect the operating state of the engine. The electronic control unit duty controls the vacuum switching valve in accordance with data from the sensors. The control unit also serves to suppress resonance of the engine and the engine mounts when purged fuel-vapor is being supplied to the engine.

20 Claims, 16 Drawing Sheets

FUEL-VAPOR EMISSION CONTROL APPARATUS FOR ENGINE

BACKGROUND OF THE INVENTION

1. Field of the Invention

The present invention relates to a fuel-vapor emission control apparatus that includes a canister for temporarily storing fuel-vapor formed in a fuel tank. The apparatus supplies the fuel-vapor in the canister to the intake system of an engine in accordance with the operating state of the engine.

2. Description of the Related Art

Fuel-vapor emission control apparatuses for engines typically include a canister for adsorbing fuel-vapor. The canister and the air intake passage of an engine are connected by a purge line. The purge line is provided with a purge control valve. The purge control valve is subjected to duty control such that the amount of purging is adjusted in accordance with the operating state of the engine. Purging amount refers to the amount of fuel-vapor introduced to the engine's air intake passage.

An oxygen sensor is located in an exhaust passage of the engine. The actual air-fuel ratio in the engine is detected based on output signals from the oxygen sensor. Feedback control of the fuel injection amount is performed such that the actual air-fuel ratio approaches a computed target air-fuel ratio.

In the above mentioned fuel-vapor emission control apparatus, the purging amount is controlled by changing the length of time during which the purge control valve is opened. Purged fuel-vapor (purged gas) enters the engine when the purge control valve is open and does not enter the engine when the valve is closed.

FIG. 7 is a timing chart showing the relationship between strokes in the cylinders #1 to #4 in an engine and the operational period of the purge control valve at a particular engine speed. In this particular case, the times during which the valve is closed correspond to each suction stroke of the cylinder #1. Therefore, purged fuel-vapor is never supplied to the cylinder #1.

Such a state, in which purged fuel-vapor is never supplied to one particular cylinder, creates wave-like fluctuations of the air-fuel ratio if continued. Wave-like fluctuation of the air-fuel ratio is known as air-fuel ratio beat phenomenon. This phenomenon prevents the air-fuel ratio from being properly controlled.

Japanese Unexamined Patent Publication No. 6-241129 discloses a technique for solving the above drawback. According to the publication, the operational frequency of the purge control valve is changed when the engine speed enters a range in which air-fuel ratio beat phenomenon takes place. This prevents one particular cylinder from being starved of fuel-vapor, thereby stabilizing the air-fuel ratio.

However, even if the operational frequency of the purge control valve is changed such that its operational frequency is not synchronized with the engine speed, the driver still feels uncomfortable because of surges and idling vibrations of the engine.

That is, even if constant fuel vapor starvation of the same cylinder is avoided, purging amount control always prevents one of the cylinders from being supplied with purged fuel-vapor. This undesirably fluctuates the engine torque. If the frequency of a torque fluctuation matches or is close to the resonance frequency of the engine mounting, the engine and the engine mounts resonate. This amplifies vibration of the engine.

SUMMARY OF THE INVENTION

Broadly speaking, the present invention relates to a fuel-vapor emission control apparatus that controls the flow rate of fuel-vapor in a purge line by duty control. The apparatus suppresses the resonance of the engine and the engine mounts when purging fuel-vapor, such that the driver and passengers do not experience uncomfortable vibrations from the engine.

Accordingly, it is an objective of the present invention to provide a fuel-vapor emission control apparatus mounted on a vehicle having an internal combustion engine and a fuel container. The engine has a cylinder and is supported by engine mounting means. The fuel-vapor emission control apparatus purges fuel-vapor from the fuel container and supplies the purged fuel-vapor to the engine. The fuel-vapor emission control apparatus includes a purge control valve, an operating state detector and a valve controller. The purge control valve controls the amount of purged fuel-vapor that is supplied to the engine. The operating state detector detects the operating state of the engine. The valve controller subjects the purge control valve to duty control in accordance with data from the operating state detector. The apparatus further includes suppressing means. The suppressing means suppresses resonance of the engine and the engine mounting means when purged fuel-vapor is being supplied to the engine.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A fuel-vapor emission control apparatus according to a first embodiment of the present invention will now be described with reference to the drawings.

Figure 1:
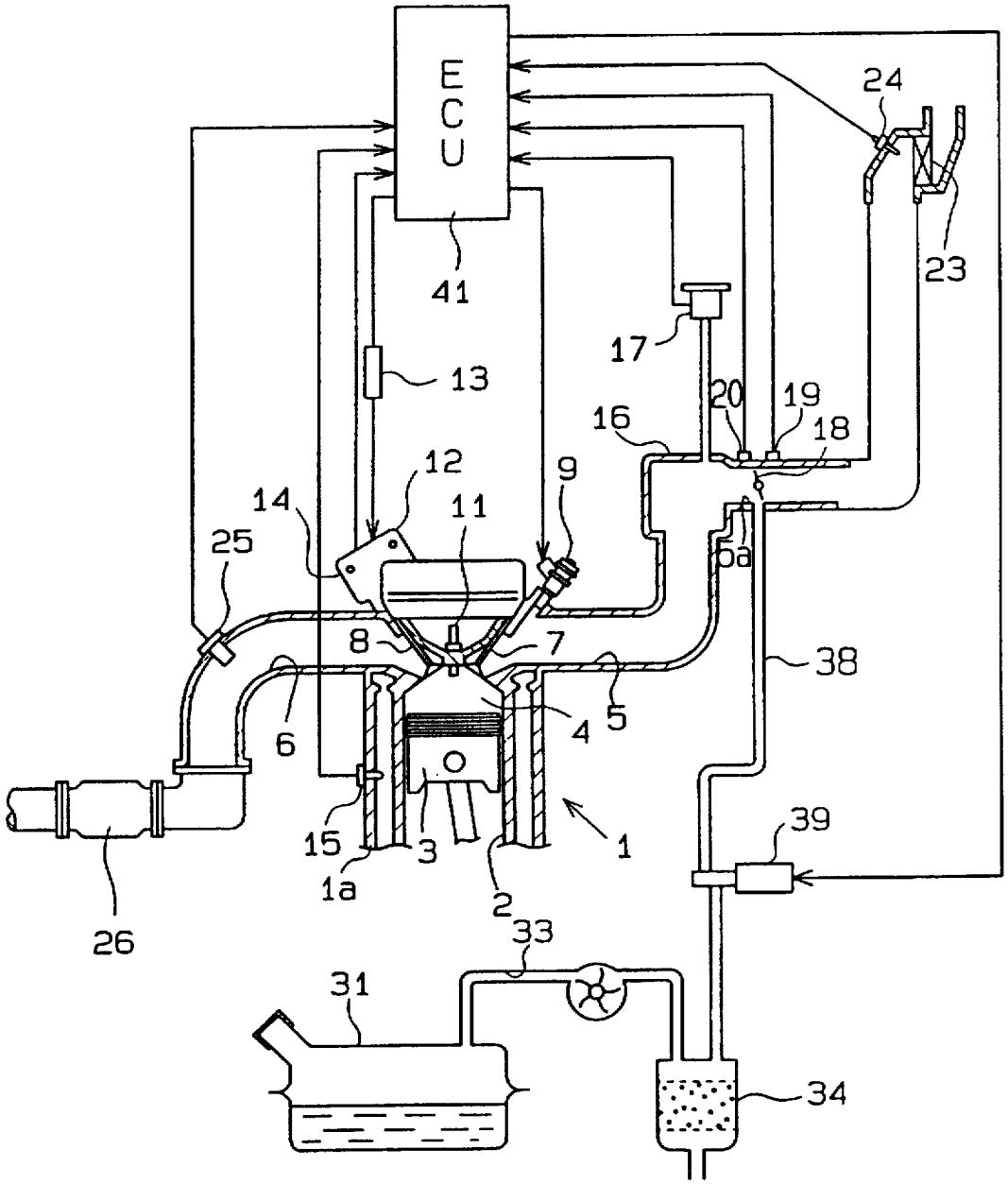
FIG. 1 is a schematic drawing showing a fuel-vapor emission control apparatus.

FIG. 1 is a schematic view illustrating a fuel-vapor emission control apparatus for a multi-cylinder type engine 1. The engine 1 has a cylinder block 1*a*. A plurality of cylinders 2 are defined in the cylinder block 1*a*. A piston 3 is accommodated in each cylinder 2. A combustion chamber 4 is defined by each piston 3 and the inner wall of the associated cylinder 2. A spark plug 11 is connected to wall of each combustion chamber 4. Each combustion chamber 4 communicates with an intake passage 5 and an exhaust passage 6. In each combustion chamber 4, an intake valve 7 and an exhaust valve 8 are located at the openings of the intake passage 5 and the exhaust passage 6, respectively. An injector 9 is provided in the vicinity of the intake valve 7.

Fuel injected through the injector 9 is mixed with the air in the intake passage 5 and is drawn into the combustion chamber 4 through the intake valve 7. A distributor 12 applies a voltage to each spark plug 11. The distributor 12 distributes high voltage from the igniter 13 to each spark plug 11 in synchronization with a crank angle of the engine 1. The spark timing of each spark plug 11 is determined by the output timing of high voltage from the igniter 13. The air-fuel mixture drawn into each combustion chamber is burned by the associated spark plug 11. This generates the drive force of the engine 1. Exhaust gas is then discharged to the exhaust passage via the exhaust valve 8.

The distributor 12 includes a rotational speed sensor 14. The speed sensor 14 detects the engine speed, and issues a signal related to the engine speed. A water temperature sensor 15 is located in the cylinder block 1*a*. The sensor 15 detects the temperature THW of cooling water of the engine 1.

A surge tank 16 is provided in the intake passage 5. The surge tank 16 suppresses the fluctuation of intake air. A diaphragm type pressure sensor 17 is attached to the surge tank 16 for detecting intake air pressure PM. A throttle valve 18 is located upstream the surge tank 16. The opening of the throttle valve 18 is controlled in accordance with manipulation of a gas pedal (not shown). The flow rate of air in the intake passage 5 is controlled by adjusting the opening of the throttle valve 18. A throttle sensor 19 and an idle switch 20 are located in the vicinity of the throttle valve 18. The throttle sensor 19 detects the opening TA of the throttle valve 18. The idle switch 20 is turned on when the throttle valve 18 is fully closed.

An air cleaner 23 is located upstream the throttle valve 18. An intake air temperature sensor 24 is provided in the vicinity of the air cleaner 23. The sensor 24 detects the temperature THA of the intake air.

An oxygen sensor 25 is located in the exhaust passage 6. The sensor 25 detects the concentration of oxygen in exhaust gas. A three way catalytic converter 26 is located in the exhaust passage 6 for cleaning the exhaust gas, which contains HC, CO and NOx.

Figure 6:
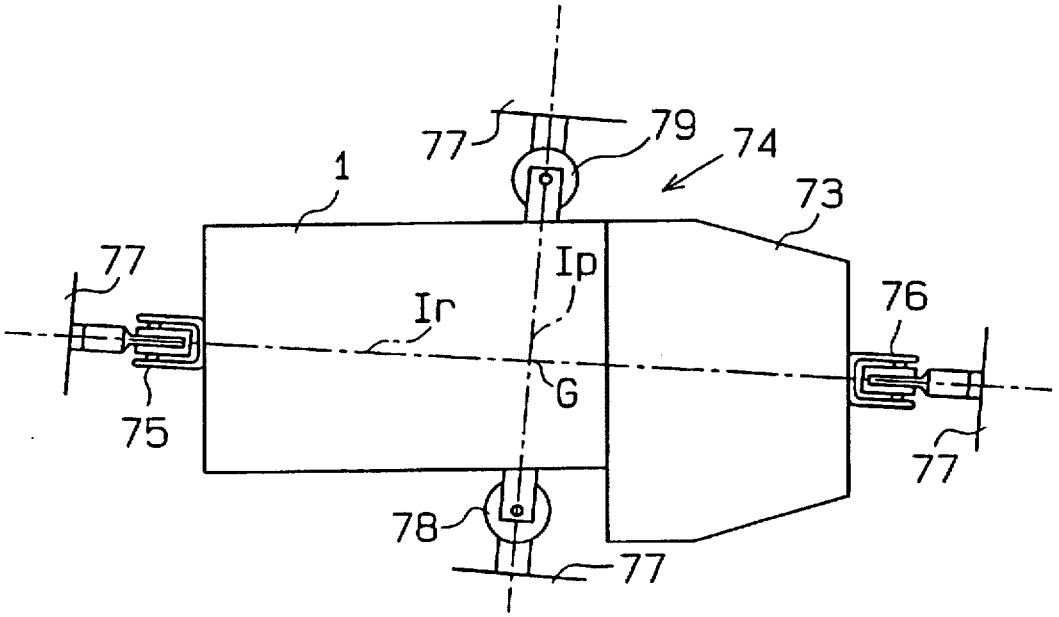
FIG. 6 is a plan view illustrating an engine and a transmission mounted on rubber vibration insulators.
Figure 7:
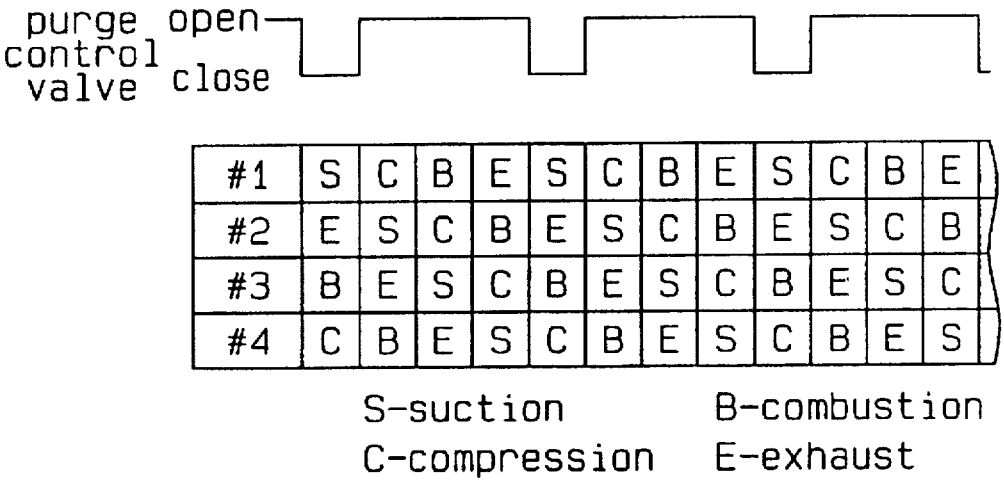
FIG. 7 is a timing chart explaining a drawback of the prior art apparatus.

As shown in FIG. 6, a transmission 73 is integrally assembled with the engine 1. The crankshaft (not shown) of the engine 1 is coupled to the rotary shaft of the transmission 73. This directly transmits the drive force of the engine 1 to the transmission 73. The engine 1 and the transmission 73 constitute an assembly 74. The assembly 74 is attached to the body 77 of a vehicle by first and second rubber vibration insulators 75, 76 and 78, 79. The first rubber vibration insulators 75, 76 are attached to the assembly 74 at both ends in the axial direction (the horizontal direction as viewed in the drawing) of the assembly 74, and the second rubber vibration insulators 78, 79 are attached to the assembly 74 at the front and rear ends. A first principal axis of inertia Ir is defined extending in the axial direction of the assembly 74 and includes the first rubber vibration insulators 75, 76. The first principal axis of inertia Ir is the roll axis of the assembly 74. A second principal axis of inertia Ip defined extending perpendicular with respect to the first principal axis of inertia Ir and includes the second rubber vibration insulators 78, 79. The axes Ir and Ip intersect at the center of gravity G of the assembly 74. The second principal axis of inertia Ip is the pitch axis (elastic center) of the assembly 74.

The rubber vibration insulators 75, 76, 78 and 79 are a conventional rubber bushing type. The elastic centers of the second rubber vibration insulators 78, 79 are located on the second principal axis of inertia Ip.

As shown in FIG. 1, a canister 34 is connected to a fuel tank 31 via a fuel-vapor passage 33. Fuel vapor generated in the fuel tank 31 is first led to the canister 34 via the fuel vapor passage 33. The canister 34 functions as an adsorbing container containing activated charcoal granules that temporarily adsorb the fuel-vapor.

The canister 34 is connected to the intake passage 5 through a purge line 38. The port 5*a* of the purge line 38 is opened in the vicinity of the throttle valve 18. This allows fuel-vapor in the canister 34 to be drawn in to the engine 1. A vacuum switching valve (VSV) 39 is provided in the purge line 38. The VSV 39 controls the flow rate of the fuel-vapor from the canister 34 to the intake passage 5 by adjusting the opening of the purge line 38. The VSV 39 is subjected to duty control. The duty control of the VSV 39 is performed by controlling the duty ratio dpg (dpg=t/T), in which T is a unit time and t is accumulated length of opening time of the valve.

The speed sensor 14, the water temperature sensor 15, the pressure sensor 17, the throttle sensor 19, the idle switch 20, the intake air temperature sensor 24 and the oxygen sensor 25 are electrically connected to an input device of an electronic control unit (ECU) 41. The injectors 9, the igniter 13 and the VSV 39 are electrically connected to an output device of the ECU 41. The ECU 41 controls the injectors 9, the igniter 13 and the VSV 39 based on signals from the sensors.

Figure 2:
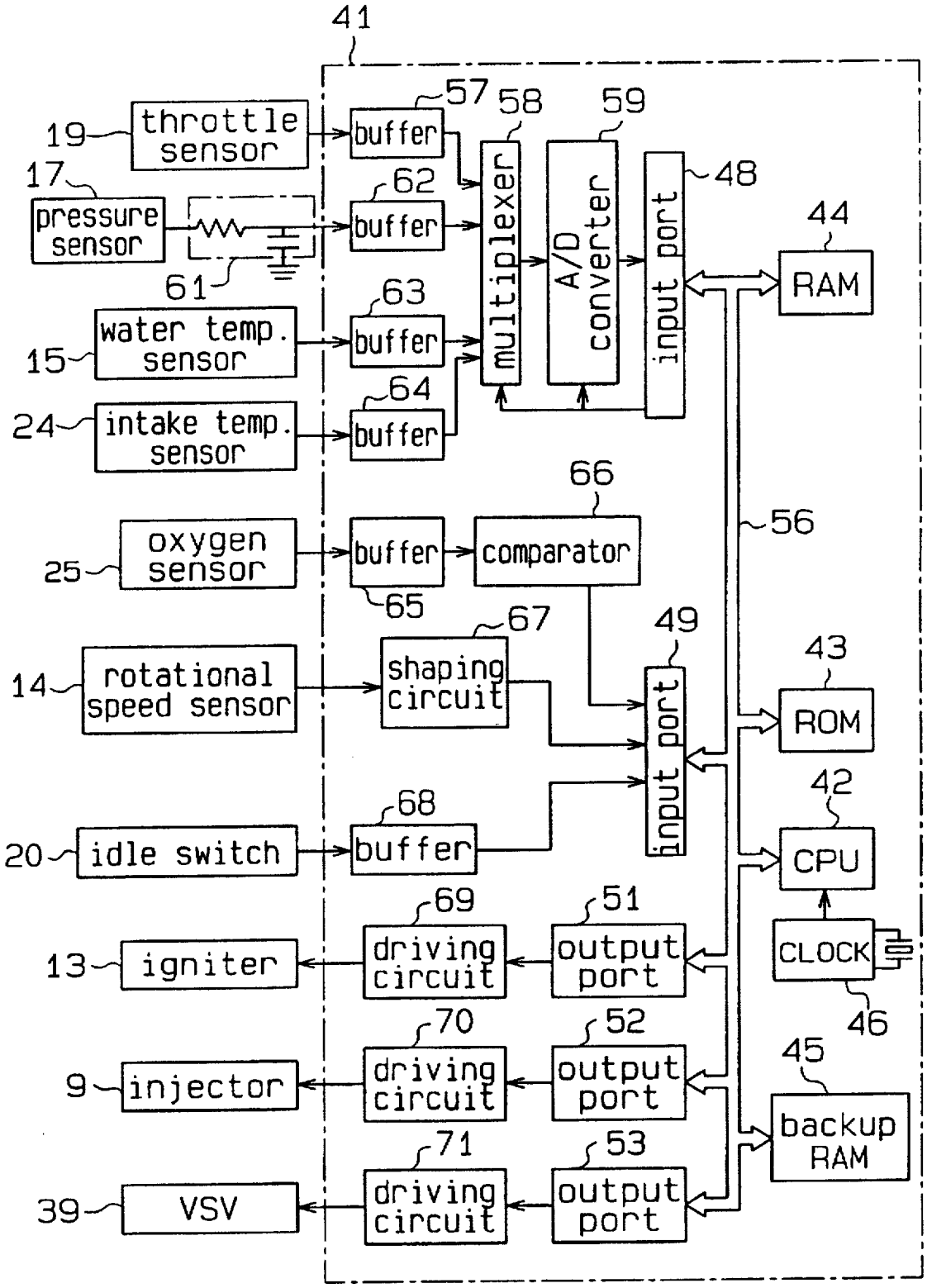
FIG. 2 is a block diagram showing electrical components of the fuel-vapor emission control apparatus of FIG. 1.

The structure of the ECU 41 will now be described with reference to the block diagram of FIG. 2. The ECU 41 includes a central processing unit (CPU) 42, a read only memory (ROM) 43, a random access memory 44, a backup memory 45, a clock signal generator 46, input ports 48, 49, and output ports 51, 52, 53. The components 42, 43, 44, 45, 46, 48, 49, 51, 52 and 53 are connected to one another by a bus 56. The CPU 42 performs various arithmetic operation in accordance with control programs previously stored in the ROM 43. The ROM 43 also stores initial data used in the arithmetic operations. The RAM 44 temporarily stores the resultant of the arithmetic operations performed by the CPU 42. The backup RAM 45 stores various data when the power is turned off. The clock signal generator 46 provides the CPU 42 with a master clock signal.

A signal from the throttle sensor 19 is sent to the input port 48 via a buffer 57, a multiplexer 58 and an analog-to-digital converter 59. A signal from the pressure sensor 17 is sent to the input port 48 via a filter circuit 61, a buffer 62, the multiplexer 58 and the analog-to-digital converter 59. The filter circuit 61 eliminates pulsating components of the pressure in the intake passage 5 contained in the pressure signal from the pressure sensor 17. A signal from the water temperature sensor 15 is sent to the input port 48 via a buffer 63, the multiplexer 58 and the analog-to-digital processor 59. A signal from the intake air temperature sensor 24 is sent to the input port 48 via a buffer 64, the multiplexer 58 and the analog-to-digital converter 59. The multiplexer 58 selectively outputs signals from the sensors 19, 17, 15, 24, 25 to the analog-to-digital converter 59, which converts the signals into digital signals.

A signal from the oxygen sensor 25 is sent to the input port 49 via a buffer 65 and a comparator 66. A signal from the speed sensor 14 is sent to the input port 49 via a shaping circuit 67. An on-off signal from the idle switch 20 is inputted to the input port 49 via a buffer 68.

Accordingly, the CPU 42 detects the throttle opening TA, the intake air pressure PM, the cooling water temperature THW, the intake air pressure THA, the oxygen concentration OX, the engine speed NE and the on-off state of the idle switch 20.

The CPU 42 controls the igniter 13 via an output port 51 and a driving circuit 69, and controls the opening of the injectors 9 via an output port 52 and a driving circuit 70. The CPU 42 also controls the VSV 39 via an output port 53 and a driving circuit 71.

The operation and advantages of the above described embodiment of the present invention will now be described. In this embodiment, the CPU 42 computes (detects) the air-fuel ratio A/F of the mixture based on the oxygen concentration OX detected by the oxygen sensor 25 in a routine (not shown), and performs feedback control of the fuel injection amount through the injectors 9 based on the computed air-fuel ratio A/F.

The computation of the duty ratio of the VSV 39 performed by the CPU 42 will now be explained. The CPU 42 reads the engine speed NE, the intake air pressure PM, and the temperature of the cooling water THW. The CPU 42 controls the duty ratio dpg of the VSV 39 based on the NE, PM and THW. The duty ratio dpg is determined in consideration of the air-fuel ratio A/F, such that the purging amount is suitable for controlling the air-fuel ratio A/F. If the parameters such as the load condition of the engine 1, the engine speed NE and the temperature of the engine 1 do not permit purging, the CPU 42 resets a purge control permitting flag to "zero" and does not start purging. If conditions needed for purging are met, on the other hand, the CPU 42 sets the purge control permitting flag to "1".

The above processing is performed in a duty ratio computing routine (not shown).

Figure 3:
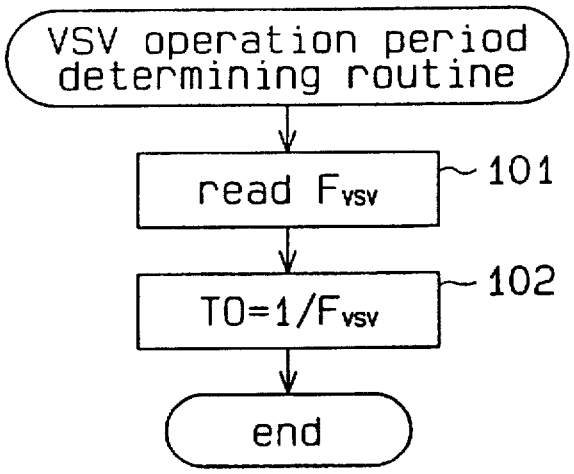
FIG. 3 is a flowchart showing a routine for determining a VSV operational period.

Among the various routines performed by the CPU 42, a VSV operational period determining routine will now be described with reference to FIG. 3. This routine is executed during every predetermined cycle of operation, for example, during each revolution of the engine's drive shaft.

Figure 5:
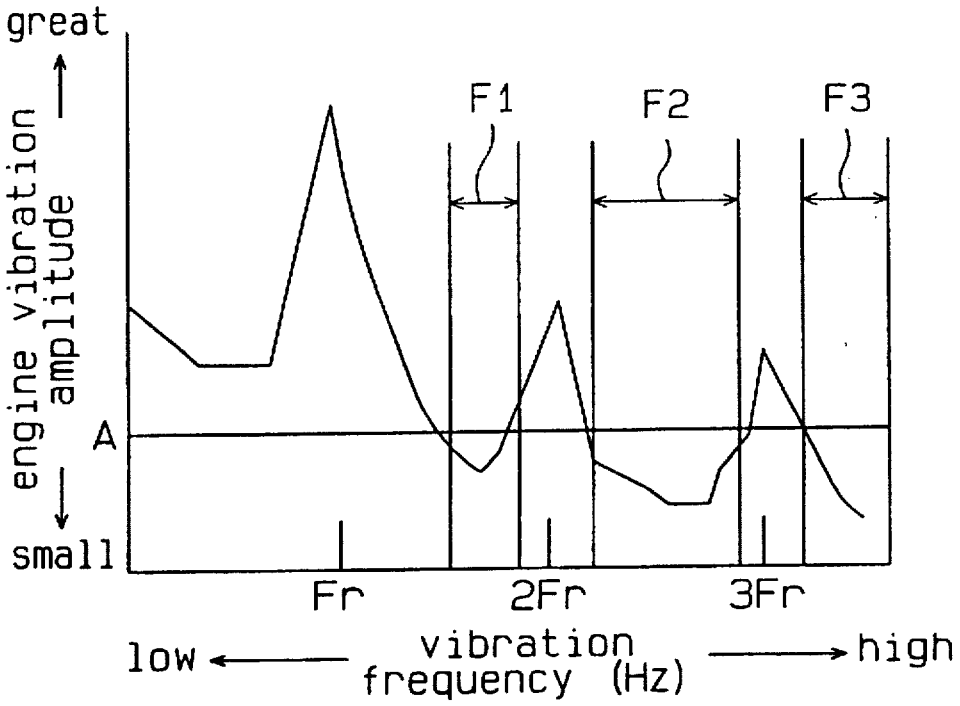
FIG. 5 is a graph showing the relationship between the frequency of a vibration and the amplitude of the engine vibration.

In step 101, the CPU 42 reads a non-resonant frequency Fvsv stored in the ROM 43. The non-resonant frequency Fvsv is a frequency that does not produce resonance of the engine 1 and the engine mounts, which is computed by the following procedure. FIG. 5 is a graph showing the amplitude of the vibration of the assembly 74 mounted on the engine mounts, which includes the rubber vibration insulators 75, 76, 78 and 79, when it is vibrated by a constant force. Ranges F1, F2 and F3 of vibration frequency are non-resonant frequency ranges in which the vibration amplitude of the assembly 74 is below a value A. The value A is a threshold value below which vibration amplitude of the assembly 74 is allowable. In this embodiment, the non-resonant frequency Fvsv is a frequency selected from the range F1. F1 is the lowest frequency range among the non-resonant frequency ranges F1, F2 and F3. The frequency Fvsv is previously stored in the ROM 43. A frequency Fr on the graph of FIG. 5 is a primary resonance frequency, which generates the greatest vibration amplitude of the engine 1. Frequencies 2Fr and 3Fr are obtained by multiplying the primary resonance frequency Fr by integers. The frequency 2Fr is a secondary resonance frequency, which is twice as high as the primary resonance frequency Fr, and 3Fr is a tertiary resonance frequency, which is three times as high as the primary resonance frequency Fr. Frequency ranges including the resonance frequencies Fr, 2Fr and 3Fr, or the ranges of vibration frequencies that cause the engine 1 to vibrate with an amplitude over the value A, are defined as resonance frequency ranges.

In step 102, the CPU 42 computes the operational period T0 of the VSV using the following equation:

$$T0=1/Fvsv$$

The VSV operational period determining routine (steps 101 and 102) functions as an operational period determining means. In this routine the CPU 42 determines the operational period of the VSV based on a non-resonant frequency in a non-resonant frequency range of the engine and the engine mounts.

Figure 4:
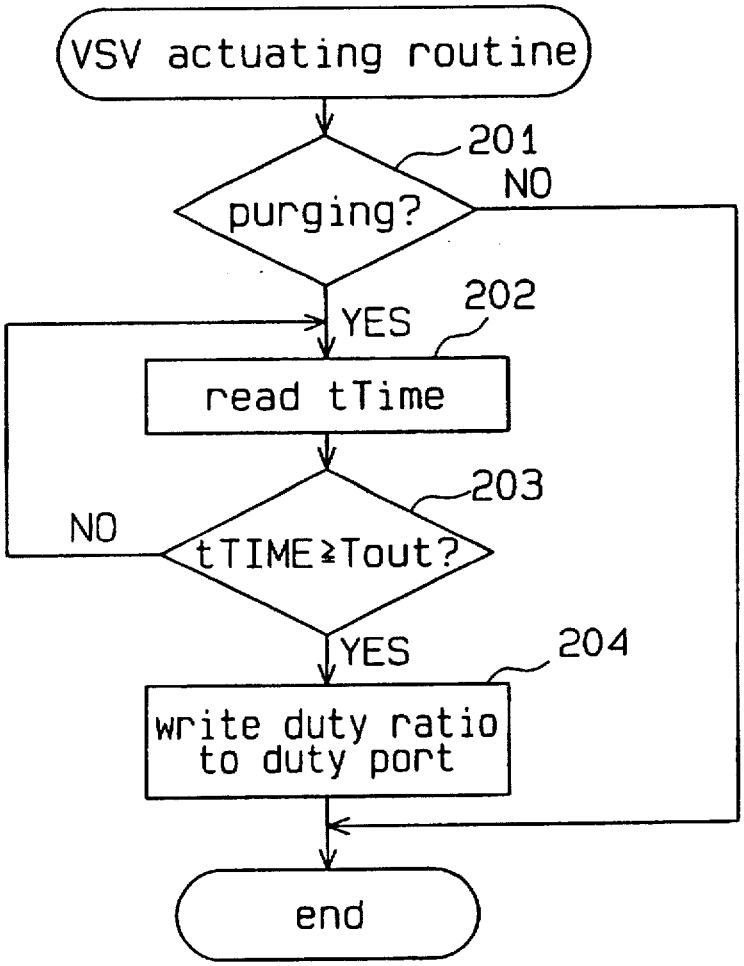
FIG. 4 is flowchart showing a routine for controlling the operation of a VSV.

FIG. 4 is flowchart showing a routine for controlling the operation of a VSV;

A VSV operation controlling routine will now be explained. FIG. 4 is the flowchart of the VSV operation controlling routine executed by the CPU 42. This routine is executed, for example, during every revolution of the engine's drive shaft.

In step 201, the CPU 42 judges whether the purge control permitting flag has a value "1", that is, it judges whether purging is occurring. If the purge control permitting flag has a value "0", the CPU 42 judges that the purging is not occurring and temporarily suspends the current routine. If the purge control permitting flag has a value "1", the CPU 42 judges that purging is occurring and moves to step 202. In step 202, the CPU 42 reads time tTIME and moves to step 203. The value tTime is the elapsed time since the routine started. In step 203, the CPU 42 judges whether tTIME has reached a VSV operating timing Tout.

If tTIME has not reached Tout, the CPU 42 returns back to step 202.

If tTIME has reached Tout in step 203, the CPU 42 moves to step 204.

In step 204, the CPU 42 writes a duty ratio dpg, which has been computed in a different routine, to the output port 53 and temporarily suspends the current routine. The output port 53 is energized for a length of time indicated by the duty ratio dpg, and opens the VSV 39 to purge fuel-vapor in the canister 34.

The above described method and apparatus have the following advantages.

In the first embodiment, a non-resonant frequency Fvsv is a frequency selected from the range F1, which has the lowest frequencies among the non-resonant frequency ranges F1, F2 and F3, and the VSV operational period T0 is computed based on the non-resonant frequency Fvsv. Compared to a case where the non-resonant frequency Fvsv is selected from the range F2 or the range F3, the VSV operational period T0 is a longer period. Therefore, the accumulated operational time of VSV is no longer than needed, and the wear on the VSV 39 is thus reduced.

In the first embodiment, a frequency in the non-resonant frequency ranges (preferably F1) is selected as the non-resonant frequency Fvsv, and the VSV operational period T0 is computed based on the frequency Fvsv. This suppresses resonant vibration of the engine 1 and the engine mounts.

A second embodiment of the present invention will now be described with reference to FIGS. 8 to 12. The differences from the first embodiment will mainly be discussed below, and like or the same reference numerals are given to those components that are like or the same as the corresponding components of the first embodiment.

If the concentration of fuel-vapor becomes higher during a purge, the amplitude of the engine vibration becomes greater. This is because a high fuel-vapor concentration increases the difference of fuel richness among the cylinders. That is, a high concentration of purged fuel-vapor makes cylinders to which the fuel-vapor is supplied richer in fuel, and makes the other cylinders to which the purged fuel-vapor is not supplied relatively leaner in fuel. Thus, the torque differences between cylinders become larger. The second embodiment of the present invention is designed to solve this problem.

Figure 8:
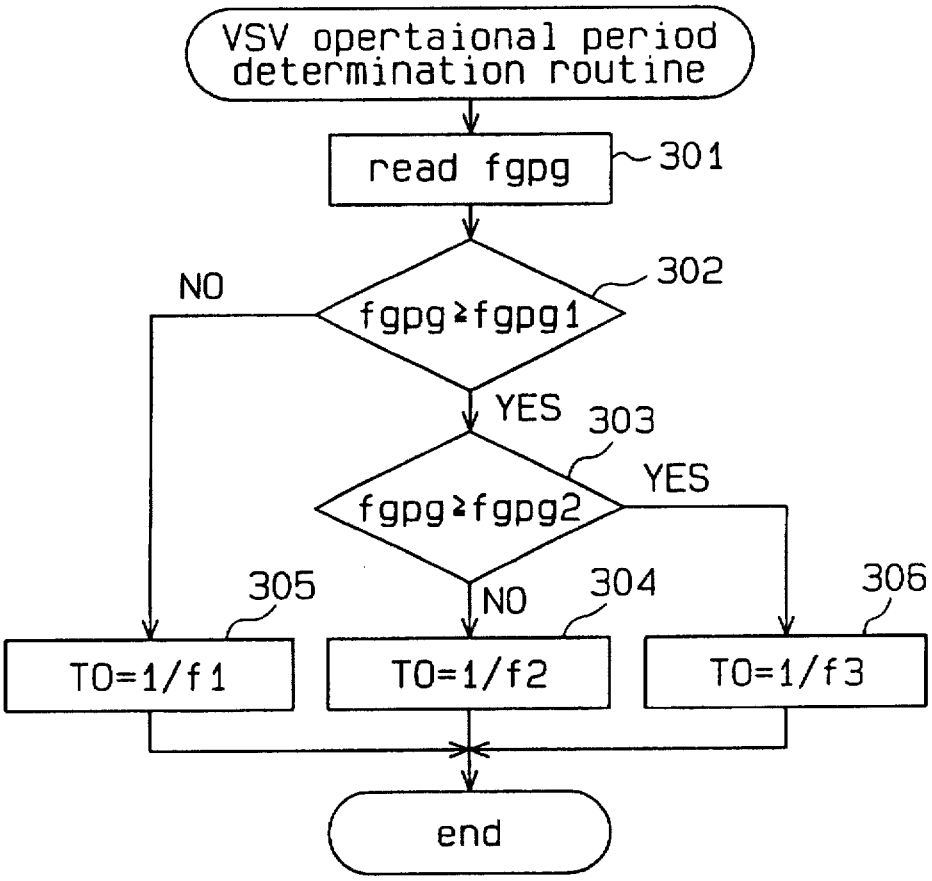
FIG. 8 is a flowchart showing a routine for determining a VSV operational period according to a second embodiment.

The second embodiment is different from the first embodiment in that the VSV operational period determining routine is executed according to the flowchart of FIG. 8. The VSV operation controlling routine of the second embodiment is the same as that (FIG. 4) of the first embodiment.

The VSV operational period determining routine of the second embodiment will now be described.

This routine is executed, for example, during every revolution of the engine's drive shaft. In step 301, the CPU 42 reads the current concentration fgpg of the urged fuel-vapor. The computation of purged fuel-vapor concentration will be explained later. In steps 302 and 303, the CPU 42 compares the current purged fuel-vapor concentration fgpg with a first reference value fgpg1 and a second reference value fgpg2, respectively. The second reference value fgpg2 is greater than the first reference value fgpg1. If the purged fuel-vapor concentration fgpg is less than the first reference value fgpg1 in step 302, the CPU moves to step 305. In step 305, the CPU 42 computes a VSV operational period T0 by an equation T0=1/f1, and temporarily suspends the current routine. The value f1 is a frequency in the non-resonant frequency range F1.

In step 302, if the purged fuel-vapor concentration fgpg is equal to or greater than the first reference value fgpg1, the CPU 42 moves to step 303. In step 303, if the purged fuel-vapor concentration fgpg is equal to or greater than the second reference value fgpg 2, the CPU 42 moves to step 306. In step 306, the CPU 42 computes the VSV operational period by an equation T0=1/f3. The value f3 is a frequency in the non-resonant frequency range F3. In step 303, if the purged fuel-vapor concentration fgpg is less than the second reference value fgpg2, the CPU 42 moves to step 304. In step 304, the CPU 42 computes the VSV operational period by an equation T0=1/f2, and temporarily suspends the current routine. The value f2 is a frequency in the non-resonant frequency range F2.

The first and second reference values fgpg 1 and fgpg 2 will now be explained.

Figure 9:
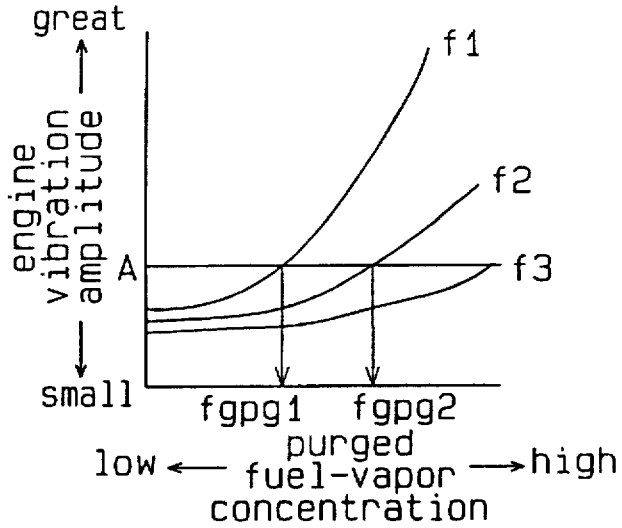
FIG. 9 is a graph showing the relationship between the concentration of fuel-vapor and the amplitude of engine vibration.

FIG. 9 shows the relationship between the amplitude of engine vibrations and the concentration of purged fuel-vapor when the frequency of vibration applied to the engine 1 is maintained at f1, f2 and f3. The values f1, f2, f3 belong to the non-resonant frequency ranges F1, F2, F3, respectively. As shown in FIG. 9, the amplitude of the engine vibration is greater when the vibration frequency is lower. That is, for any given the value of the purged fuel-vapor concentration, the frequency f1 causes the engine 1 to vibrate at a greater amplitude than the frequency f2, and, similarly, the frequency f2 causes the engine 1 to vibrate at a greater amplitude than the frequency f3. In this embodiment, values of purged fuel-vapor concentration corresponding to the intersections of the amplitude value A and frequencies f1 and f2 are used as the first and second reference values fgpg1 and fgpg2, respectively. The value A, as in the graph of FIG. 5, is a threshold value of engine vibration amplitude below which vibration is acceptable.

In this embodiment, steps 302 and 303 function to determine which non-resonant frequency range among F1, F2 and F3 should be used for computing the VSV operational period T0.

When the purged fuel-vapor concentration fgpg is less than the first reference value fgpg1, the CPU 42 selects the non-resonant frequency range F1. When the concentration fgpg satisfies an equation fgpg1≦fgpg<fgpg2, the CPU 42 selects the non-resonant frequency range F2. When the concentration is equal to or greater than the second reference value fgpg2, the CPU 42 selects the non-resonant frequency range F3. The reason for this processing is as follows.

The operational frequency of the VSV 39 needs to be maintained low because a high operational frequency deteriorates the accuracy of flow rate control of the VSV 39. Further, a lower operational frequency improves the durability of the VSV 39.

Figure 10:
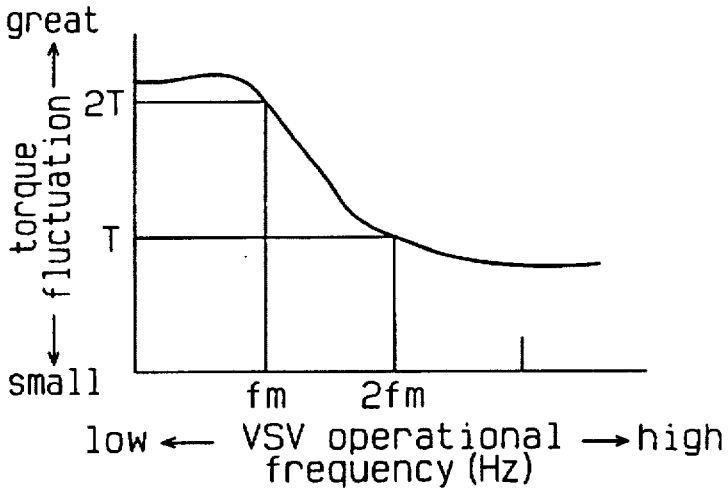
FIG. 10 is a graph showing the relationship between the VSV operational period and engine torque fluctuations.

FIG. 10 shows the relationship between torque fluctuations of the engine 1 and the operational frequency of the VSV 39. The torque fluctuations decrease as the VSV operational frequency increases. This is because a higher operational frequency of the VSV 39 decreases the amount of fuel-vapor drawn into one cylinder during its suction stroke. The purged fuel-vapor is thus more equally distributed to all the cylinders. For example, the engine torque fluctuation is 2T when the VSV operational frequency is fm, and becomes T, which is half of 2T, when the VSV operational frequency is doubled to 2fm.

The frequencies f1, f2 and f3 used for computing the VSV operational period T0 in steps 304, 305 and 306 satisfy the following equations:

$$f2=2f1,\ f3=3f1$$

As described above, the CPU 42 selects a frequency among three different frequencies f1, f2 and f3 in the routine of FIG. 8 in accordance with the concentration of the purged fuel-vapor, and each of the frequencies f1, f2 and f3 is selected from the non-resonant frequency ranges F1, F2 and F3, respectively. That is, when the purged fuel-vapor concentration is high, the engine torque fluctuation is significantly suppressed, and when the concentration is low, the deterioration of the VSV flow rate control accuracy is prevented.

The computation of the purged fuel-vapor concentration will now be explained with reference to FIG. 12.

As in the first embodiment, the oxygen sensor 25, which functions as an air-fuel ratio detection means, detects the concentration of oxygen in the exhaust passage 6. The CPU 42 computes (detects) the air-fuel ratio A/F based on the detected oxygen concentration in a different routine and performs feedback control of the fuel injection amount from the injectors 9 based on the computed air-fuel ratio A/F.

Starting a purge control causes the air-fuel ratio A/F to deviate from the theoretical air-fuel ratio (stoichiometric ratio). The CPU 42 computes an air-fuel ratio fluctuation coefficient ΔA/F and gives a compensation value that corresponds to the coefficient ΔA/F to the fuel injection amount, so that the air-fuel ratio A/F approaches the theoretical air-fuel ratio.

During purge control, changes in the concentration of purged fuel-vapor causes the air-fuel ratio A/F to deviate from a target air-fuel ratio. The CPU 42 computes an air-fuel ratio fluctuation coefficient ΔA/F and applies a compensation value that corresponds to the coefficient ΔA/F to the fuel injection amount so that the air-fuel ratio A/F approaches the target air-fuel ratio.

A purged fuel-vapor compensation value FPG will now be explained. The purged fuel-vapor compensation value FPG is a value used for reducing fuel supplied to the engine by the amount that corresponds to the fuel supplied through the purge line 38. The compensation value FPG is proportionate to the concentration of purged fuel-vapor. The compensation value FPG, the purged fuel-vapor concentration fgpg and purging ratio PG satisfy the following equation:

$$fgpg=FPG/PG$$

The purging ratio is determined in accordance with the operational state of the engine 1. The maximum purging ratio is used in this embodiment. The maximum purging ratio is the ratio of the purged fuel-vapor to the intake air when the VSV 39, which functions as a purging control valve, is fully opened. The maximum purging ratio is represented by a function of the engine load (intake air amount/engine speed) and the engine speed NE.

The computation of the above mentioned air-fuel ratio fluctuation coefficient ΔA/F will now be explained. The coefficient ΔA/F is computed based on the average value FAFAV of the feedback compensation coefficient FAF, which is varied by changes in output signals from the oxygen sensor 50.

Figure 12A:
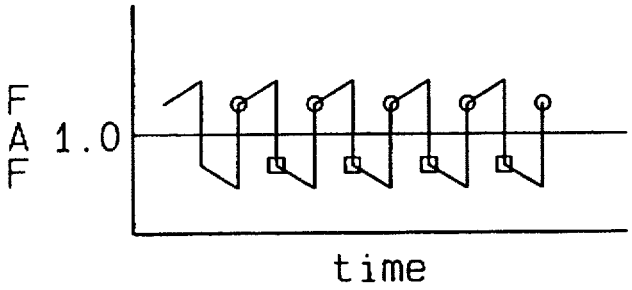
FIGS. 12(*a*), 12(*b*) and 12(*c*) are timing charts showing feedback compensation coefficient.
Figure 12B:
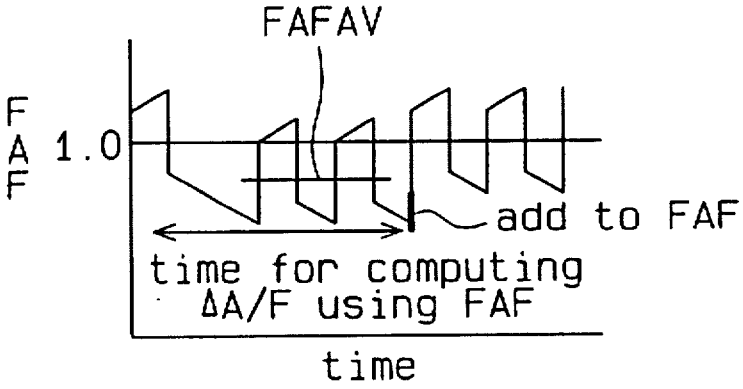
Figure 12C:
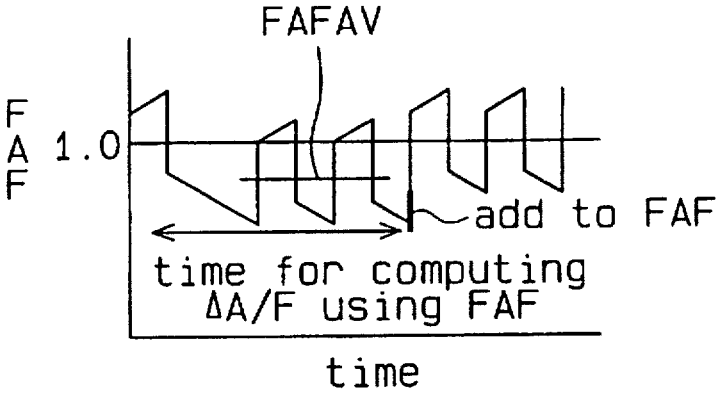

FIG. 12(*a*) shows the feedback compensation coefficient FAF when purged fuel-vapor is not supplied to the engine 1. An average value FAFAV is the average of the points represented by the symbols ○ and □, in this case 1.0. Therefore, the air-fuel ratio fluctuation coefficient ΔA/F is computed by the following equation (1):

$$\Delta A/F=1.0-FAFAV=0 \quad (1)$$

The fuel injection amount Tau when purged fuel-vapor is not supplied to the engine 1 is computed by the following equation (2):

$$Tau=TP\times FAF \quad (2)$$

The basic injection time TP is the period of time for injecting a certain amount of fuel through the injectors 9 to obtain the theoretical air-fuel ratio. The time TP is computed based on the intake air amount and the engine speed NE.

Next, the supply of purged fuel-vapor to the engine 1 will be explained.

In this case, as shown in FIG. 12(*b*), the feedback compensation coefficient FAF is decreased because of purged fuel-vapor. Therefore, the air-fuel ratio fluctuation coefficient ΔA/F is computed by the following equation:

$$\Delta A/F=1.0-FAFAV$$

The purged fuel-vapor compensation value FPG, which is computed in a different routine, is used for purge control. This improves the speed and accuracy of the air-fuel ratio control. That is, if the compensation value FPG is computed by the following equation:

$$FPG=K\times\Delta A/F$$

(K is a constant), the feedback compensation coefficient FAF is computed by the following equation:

$$FAF(\text{compensated})=FAF(\text{before compensation})+K\times\Delta A/F=FAF(\text{before compensation})+FPG$$

The fuel injection amount Tau is reduced by the amount K×ΔA/F, or by the amount of the purged fuel-vapor compensation value FPG. Therefore, the compensated fuel injection amount Tau is represented by the following equation (3):

$$Tau=TP\times(FAF-FPG) \quad (3)$$

Changes in the purged fuel-vapor concentration during purge control cause the feedback compensation coefficient FAF to deviate as shown in FIG. 12(*c*). A compensated amount of purged fuel-vapor is computed in consideration of changes in the concentration of the purged fuel. That is, the compensated amount of purged fuel is obtained by adding the purged fuel-vapor compensation value FPG to the feedback compensation coefficient FAF. The air-fuel ratio fluctuation coefficient ΔA/F, the feedback compensation coefficient FAF (compensated), and the purged fuel-vapor compensation value FPG (of the current routine) are computed by the following equations:

$$\Delta A/F=1.0-FAFAV$$

$$FAF(\text{compensated})=FAF(\text{before compensation})+\Delta A/F$$

$$FPG(\text{in the current routine})=FPG(\text{in the previous routine})+\Delta A/F$$

The compensated fuel injection amount Tau is obtained by the equation (3).

Figure 13:
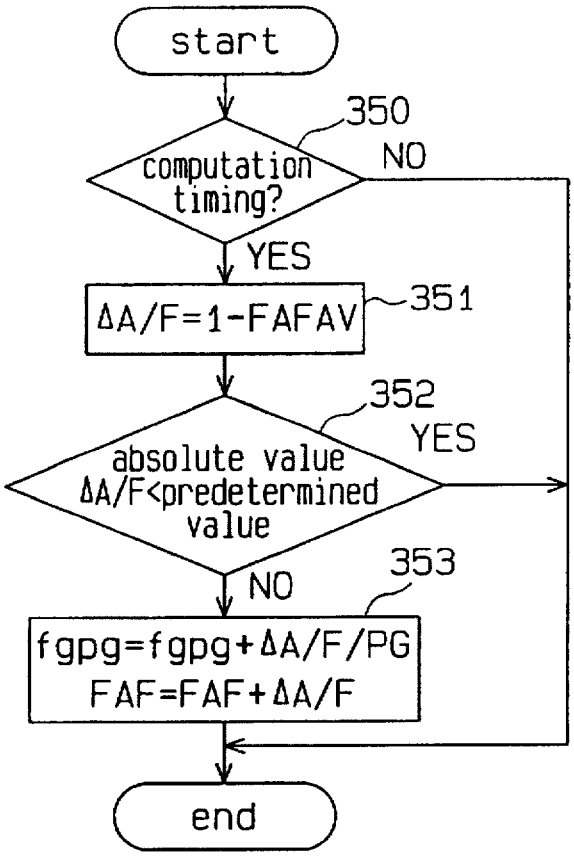
FIG. 13 is a flowchart showing a routine for computing a concentration of purged fuel-vapor.

A routine for computing purged fuel concentration will now be explained with reference to FIG. 13. This routine is executed during every predetermined cycle of operation.

In step 350, the CPU 42 judges whether the present time is a time for performing a computation according to the computation timing. The computation timing is computed in a different routine. If the present time is not a computation time according to the computation timing, the CPU 42 temporarily suspends the current routine. If the present time is a computation time, the CPU 42 moves to step 351. In step 351, the CPU 42 computes a deviation of the air-fuel ratio ΔA/F based on the deviation of the feedback compensation coefficient FAF by the following equation:

$$\Delta A/F=1.0-FAFAV.$$

In step 352, the CPU 42 judges whether the absolute value of the air-fuel ratio fluctuation coefficient ΔA/F is less than a predetermined value for establishing a dead zone. If the absolute value of the coefficient ΔA/F is less than the predetermined value, the CPU 42 temporarily suspends the current routine. If the absolute value of the coefficient ΔA/F is equal to or greater than the predetermined value, the CPU 42 moves to step 353. In step 353, the CPU 42 computes the purged fuel-vapor concentration fgpg and the feedback compensation coefficient FAF according to the following equations and stores the resultant data in the RAM 44.

$$fgpg(\text{current})=fgpg(\text{previous})+\Delta fgpg(\text{compensation value for purged fuel-vapor concentration})$$

$$FAF(\text{compensated})=FAF(\text{not compensated})+\Delta A/F$$

The above described second embodiment has the following advantages.

One of the three non-resonant frequency ranges F1, F2 and F3 is selected in accordance with the purged fuel-vapor concentration for computing the VSV operational period T0.

Figure 11:
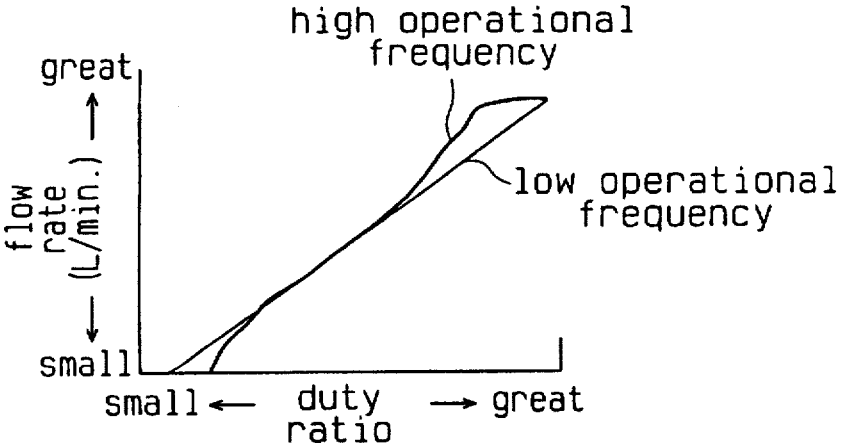
FIG. 11 is a graph showing the relationship between the VSV operational period and flow rate of fuel vapor through the VSV.

The accuracy of the flow rate control by the VSV 39 is reflected on the purge control. Operating an electromagnetic valve at a high frequency generally increases the temperature of the solenoid and generates thermal resistance. The thermal resistance lowers the current, thereby reducing the driving power of the solenoid. This deteriorates the flow rate control accuracy. The graph of FIG. 11 shows the relationship between the flow rate of fuel-vapor through the VSV 39 and the duty ratio when the VSV operational frequency is low and high. The line corresponding to the low VSV operational frequency is linear at the entire duty ratio range, while the line corresponding to the high VSV operational frequency is less linear in a lower duty ratio range and a higher duty ratio range. In this embodiment, the VSV operational frequency is maintained low. This improves the flow rate control accuracy and the durability of the VSV 39.

In this embodiment, one of the three different non-resonant frequency ranges is selected for computing VSV operational period depending on the concentration of purged fuel-vapor. Therefore, if the purged fuel-vapor concentration is high, torque fluctuation is significantly suppressed. If the purged fuel-vapor concentration is low, the flow rate control accuracy of the VSV does not deteriorate.

A third embodiment of the present invention will now be described with reference to FIGS. 14 to 16. The differences from the second embodiment will mainly be discussed below.

Figure 14:
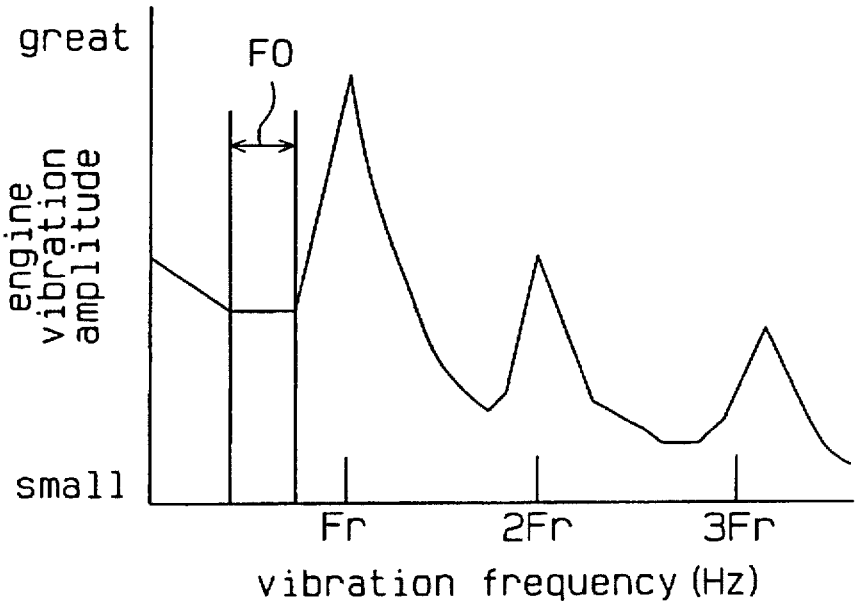
FIG. 14 is a graph showing of the relationship between the frequency of a vibration and the amplitude of the engine vibration according to a third embodiment.

FIG. 14, similar to FIG. 5, is a graph showing the amplitude of the vibration of the engine 1 (the assembly 74) on the engine mounts when it is vibrated by a constant force. FIG. 15 is a flowchart showing a VSV operational period determining routine. FIG. 16 is a graph showing the relationship between the duty ratio of the VSV 39 and the torque fluctuations of the engine 1.

Figure 16:
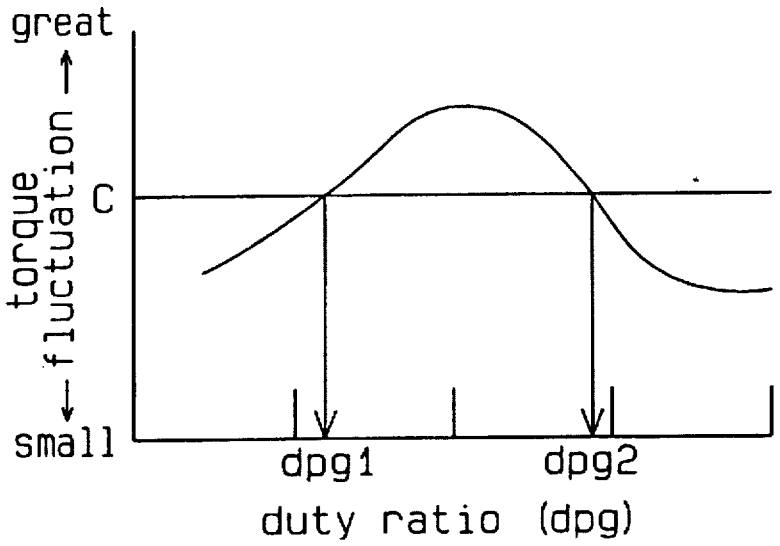
FIG. 16 is a graph showing the relationship between duty ratio of the VSV and engine torque fluctuations.

As shown in FIG. 16, when the duty ratio is smaller than the first reference value dpg1 or greater than the second reference value dpg2, the torque fluctuation is smaller than a reference value C.

Figure 15:
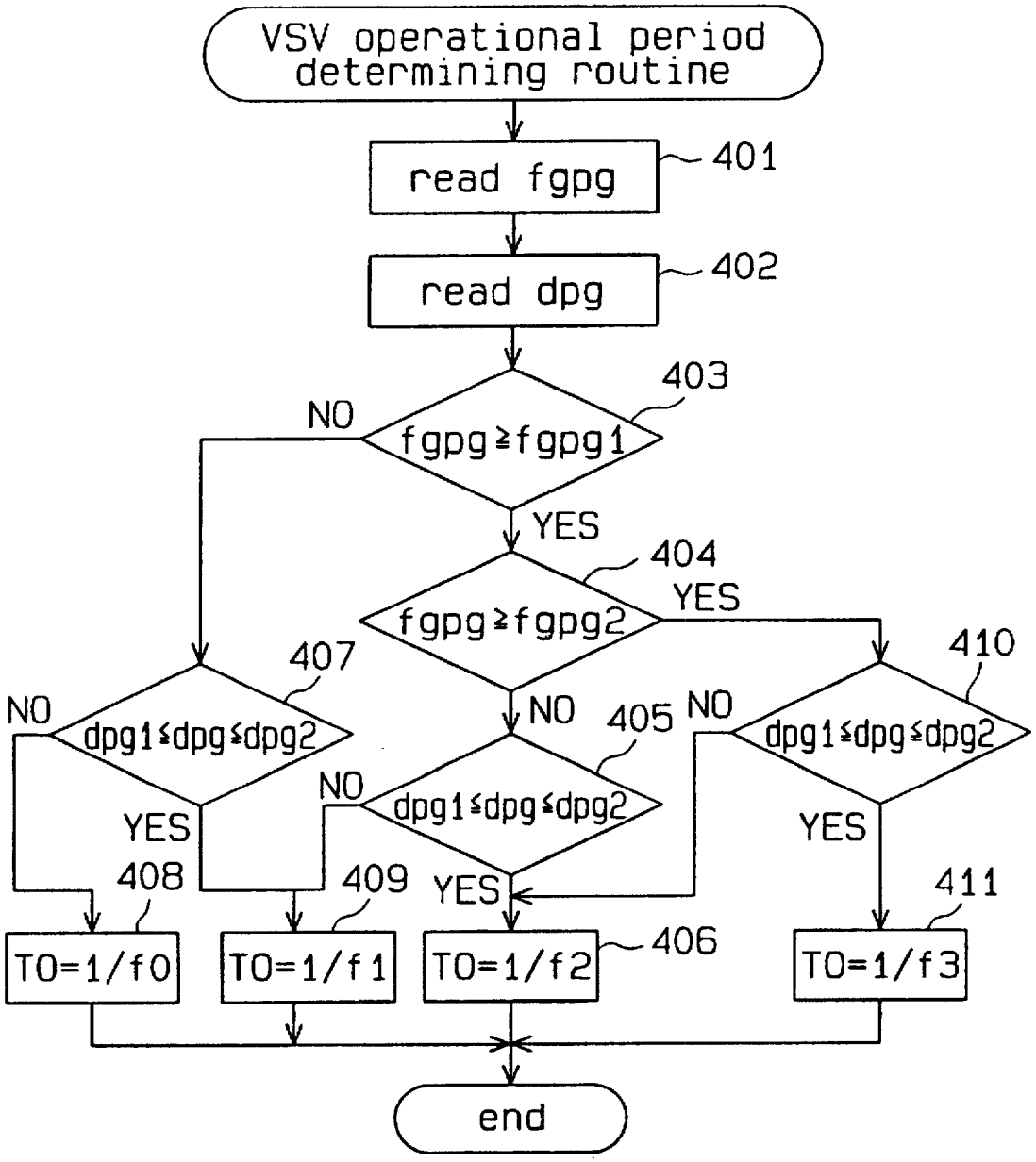
FIG. 15 is a flowchart showing a routine for determining VSV operational period according to a third embodiment.

In the third embodiment, the CPU 42 uses this data when executing the VSV operational period determining routine of the flowchart of FIG. 15.

In step 401, the CPU 42 reads the current concentration of purged fuel-vapor fgpg. In step 402, the CPU 42 reads the duty ratio dpg computed in a different routine. In steps 403 and 404, the CPU 42 compares the current purged fuel-vapor concentration with the first reference value fgpg1 and the second reference value fgpg2. In step 403, if the purged fuel-vapor concentration fgpg is smaller than the first reference value fgpg1, the CPU 42 moves to step 407. If the purged fuel-vapor concentration fgpg is equal to or greater than the value fgpg1, the CPU 42 moves to step 404. In step 404, the CPU 42 judges whether the purged fuel-vapor concentration fgpg is equal to or greater than the second reference value fgpg2. If the purged fuel-vapor concentration fgpg is smaller than the second reference value fgpg2, the CPU 42 moves to step 405. If the purged fuel-vapor concentration fgpg is equal to or greater than the second reference value fgpg2, the CPU 42 moves to step 410.

In steps 407, 405 and 410, the CPU 42 judges whether the duty ratio dpg is between the first duty reference value dpg1 and the second duty reference value dpg2. That is, the CPU 42 judges the values dpg, dpg1 and dpg2 satisfy the following inequality.

$$dpg1 \leq dpg \leq dpg2$$

In step 407, if the duty ratio is out of the range between the reference values dpg1 and dpg2, the CPU 42 moves to step 408. In step 408, the CPU 42 computes the VSV operational period T0 by an equation T0=1/f0, and temporarily suspends the subsequent processing.

As shown in FIGS. 14 and 5, a non-resonant vibration frequency range F0 is a frequency range that is lower than the non-resonant vibration frequency range F1. In this range, the amplitude of the engine vibration is small. The value f0 is a frequency in the non-resonant vibration frequency range F0.

In step 407, if the duty ratio is in the range between the reference values dpg1 and dpg2, the CPU 42 moves to step 409. In step 409, the CPU 42 computes the VSV operational period T0 by the equation T0=1/f1, and temporarily suspends the subsequent processing. The value f1 is a frequency in the non-resonant vibration frequency range F1.

In step 405, if the duty ratio dpg is out of the range between the reference values dpg1 and dpg2, the CPU 42 moves to step 409. If the duty ratio dpg is in the range between the values dpg1 and dpg2, the CPU 42 moves to step 406. In step 406, the CPU 42 computes the VSV operational period T0 by the equation T0=1/f2, and temporarily suspends the subsequent processing. The value f2 is a frequency in the non-resonant vibration frequency range F2.

In step 410, if the duty ratio dpg is out of the range between the reference values dpg1 and dpg2, the CPU 42 moves to step 406. If the duty ratio dpg is in the range between the values dpg1 and dpg2, the CPU 42 moves to step 411. In step 411, the CPU 42 computes the VSV operational period T0 by the equation T0=1/f3, and temporarily suspends the subsequent processing. The value f3 is a frequency in the non-resonant vibration frequency range F3.

As described above, the CPU 42 uses a frequency that belongs to either of non-resonant vibration frequency ranges F0, F1, F2 or F3.

The above described third embodiment has the following advantages.

The CPU 42 selects a frequency for computing the VSV operational period from a plurality of non-resonance vibration frequency ranges in accordance with the values of the purged fuel-vapor concentration fgpg and the duty ratio dpg. Therefore, compared to the first embodiment, the operational frequency of the VSV 39 is selected from a wider range. In this embodiment, one of the four different non-resonant vibration frequency ranges is selected for computing VSV operational period depending on the concentration of purged fuel-vapor and the duty ratio. Therefore, if the purged fuel-vapor concentration is high, torque fluctuation is significantly suppressed. If the purged fuel-vapor concentration is low, the flow rate control accuracy of the VSV 39 does not deteriorate. Further, if the duty ratio has a value that increases the torque fluctuations, an operational period of the purge control valve is determined such that torque fluctuations decrease.

A fourth embodiment of the present invention will now be described with reference to FIGS. 17 to 20.

Figure 19:
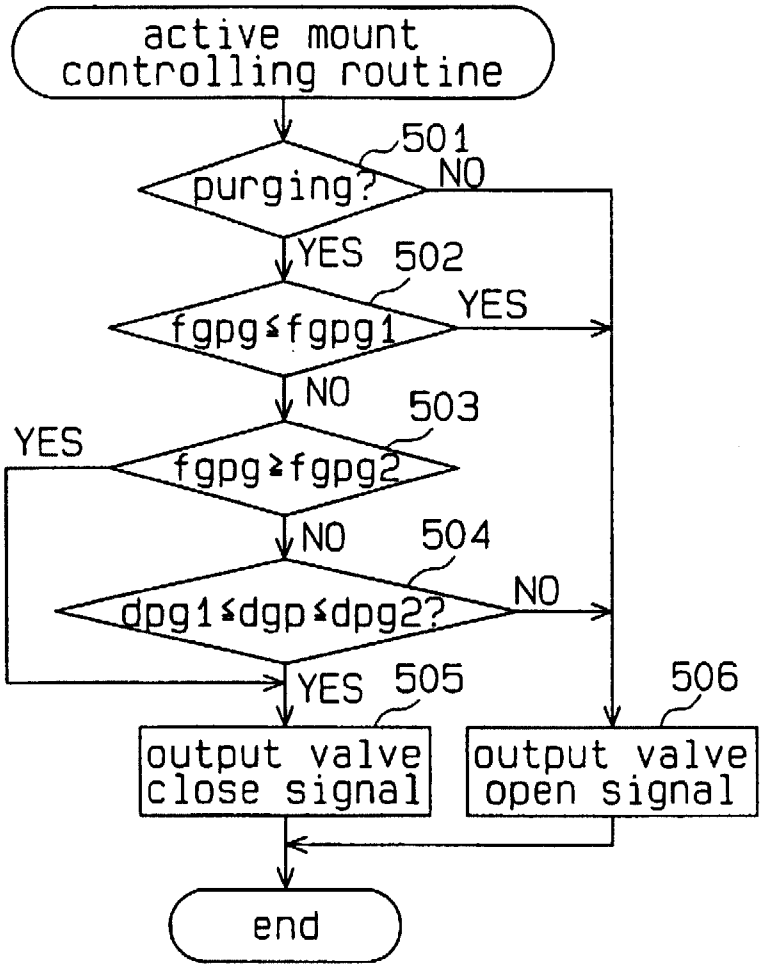
FIG. 19 is a flowchart showing a routine for controlling the active mount of FIG. 18.

A difference of this embodiment from the first embodiment is that the rubber vibration insulators 78 and 79 are replaced with active control mounts 111 and 112. Further, a mount control routine of FIG. 19 is executed by the CPU 42.

Figure 18:
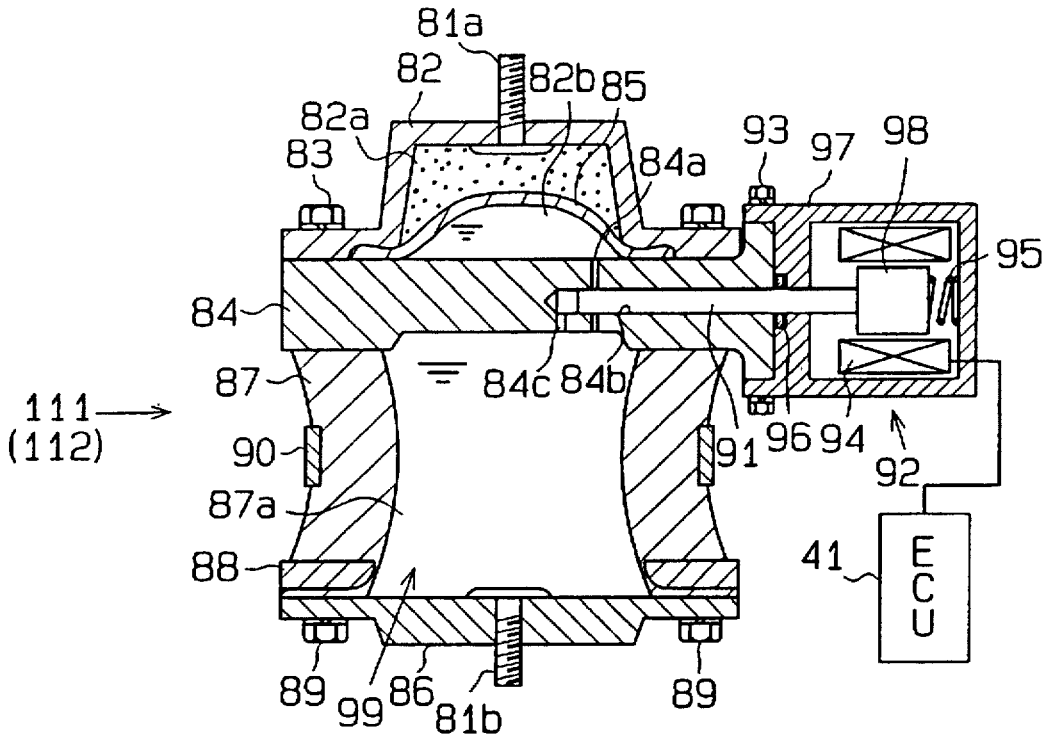
FIG. 18 is a cross-sectional view illustrating an active mount according to a fourth embodiment.

Since the active control mounts 111, 112 have the same structure, only the mount 111 will be described with reference to FIG. 18. Each mount 111 is attached to the engine 1 at cover 82 by first assembly bolt 81*a*. Each mount 111 is attached to the body of a vehicle at a bottom plate 86 by a second assembly bolt 81*b*. Each cover 82 is secured to a bulkhead 84 by bolts 83. The space defined by the cover 82 and the bulkhead 84 is divided into two spaces by a rubber diaphragm 85. The upper space functions as an air chamber 82*a*, and the lower apace functions as a second liquid chamber 82*b*.

A cylindrical elastic body 87 is located between the bulkhead 84 and the bottom plate 86. The elastic body 87 is made of an oil proof material. The elastic body 87 has an annular plate 88 located in its bottom portion. Fastening the bolts 89 to the plate 88 secures the plate 88 to the bottom plate 86, thereby causing the elastic body 87 to adhere to the bottom plate 86. The elastic body 87, the bulkhead 84 and the bottom plate 86 define a first liquid chamber 87*a*. A ring 90 is fitted about the center portion of the elastic body 87 to restrict the deformation of the elastic body 87.

A communication hole 84*a* is formed in the bulkhead 84. The hole 84*a* communicates the first liquid chamber 87*a* with the second liquid chamber 82*b*. The hole 84*a* creates a damping effect as the liquid moves between the first and second chambers 87*a* and 82*b*. A rod hole 84*b* is formed perpendicular to the communication hole 84*a* in the bulkhead 84. A rod valve 91 is slidably accommodated in the rod hole 84*b*. The rod valve 91 closes the communication hole 84*a*. The distal end of the rod hole 84*b* and the first liquid chamber 87*a* are communicated by a communication hole 84*c*. The communication hole 84*c* allows the liquid to enter and exit the distal portion of the rod hole 84*b*, thereby lubricating the motion of the rod valve 91.

A valve actuator 92 is located adjoining the bulkhead 84. An electromagnetic solenoid 94 is accommodated in a housing of the actuator 92. The housing 97 of the actuator 92 is secured to the bulkhead 84 by a plurality of bolts 93. The proximal end of the rod valve 91 is coupled to an armature 98 of the solenoid 94. The armature 98 is urged by a spring 95. When the solenoid 94 is not excited, the force of the spring 95 causes the rod valve 91 to close the communication hole 84*a*. An O-ring 96 is located between the rod valve 91 and the housing 97. The O-ring 96 prevents the liquid in the chambers 82*b* and 87*a* from leaking.

Exciting the solenoid 94 moves the armature 98 against the force of the spring 95, thereby pulling the rod valve 91 from the rod hole 84*b*. This opens the through hole 84*a*, thereby communicating the first and second liquid chambers 87*a* and 82*b*. Relative movement of the engine 1 with respect to the vehicle body 77 deforms the elastic body 87. Since the deformation of the elastic body 87 is restricted by the ring 90, the deformation causes liquid flow between the liquid chambers 87*a* and 82*b*. When the liquid flows between the chambers 87*a* and 82*b*, the viscosity resistance of the liquid generates a damping force; that is, the active control mount 111 has high damping characteristics and low spring rigidity.

When the spring 95 causes the rod valve 91 to close the communication hole 84*a*, liquid flow between the first and second liquid chambers 87*a* and 82*b* is prohibited. This increases the stiffness of the elastic body 87; that is, the active control mount 111 has high spring rigidity and low damping characteristics.

Figure 20:
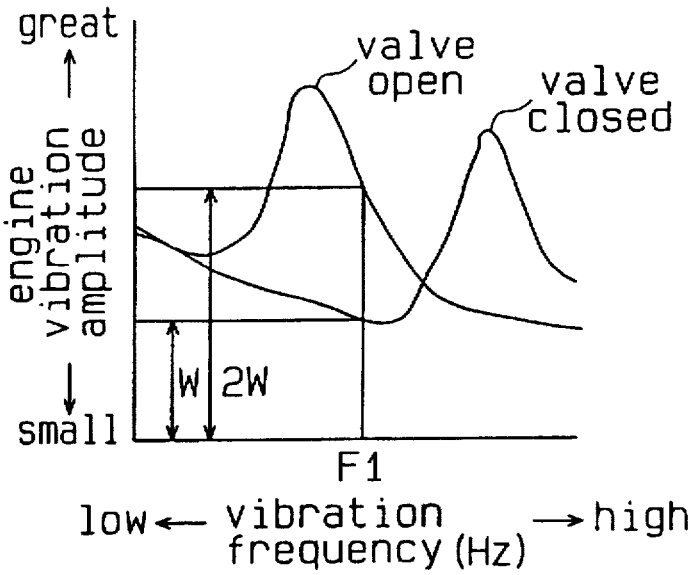
FIG. 20 is a graph showing of the relationship between the frequency of a vibration and the amplitude of the engine vibration according to the fourth embodiment.

FIG. 20 shows the resonance characteristics of the active control mounts 111, 112. When the communication hole 84*a* is closed by the rod valve 91, the resonance frequency of the mounts 111, 112 is relatively low. When the communication hole 84*a* is opened by the rod valve 91, the resonance frequency of the mounts 111, 112 is relatively high. In this embodiment, the CPU 42 changes the resonance characteristics of the active control mounts 111, 112, such that the vibration frequency of the engine 1 caused by operation is out of the resonance frequency range of the active control mounts.

Figure 17:
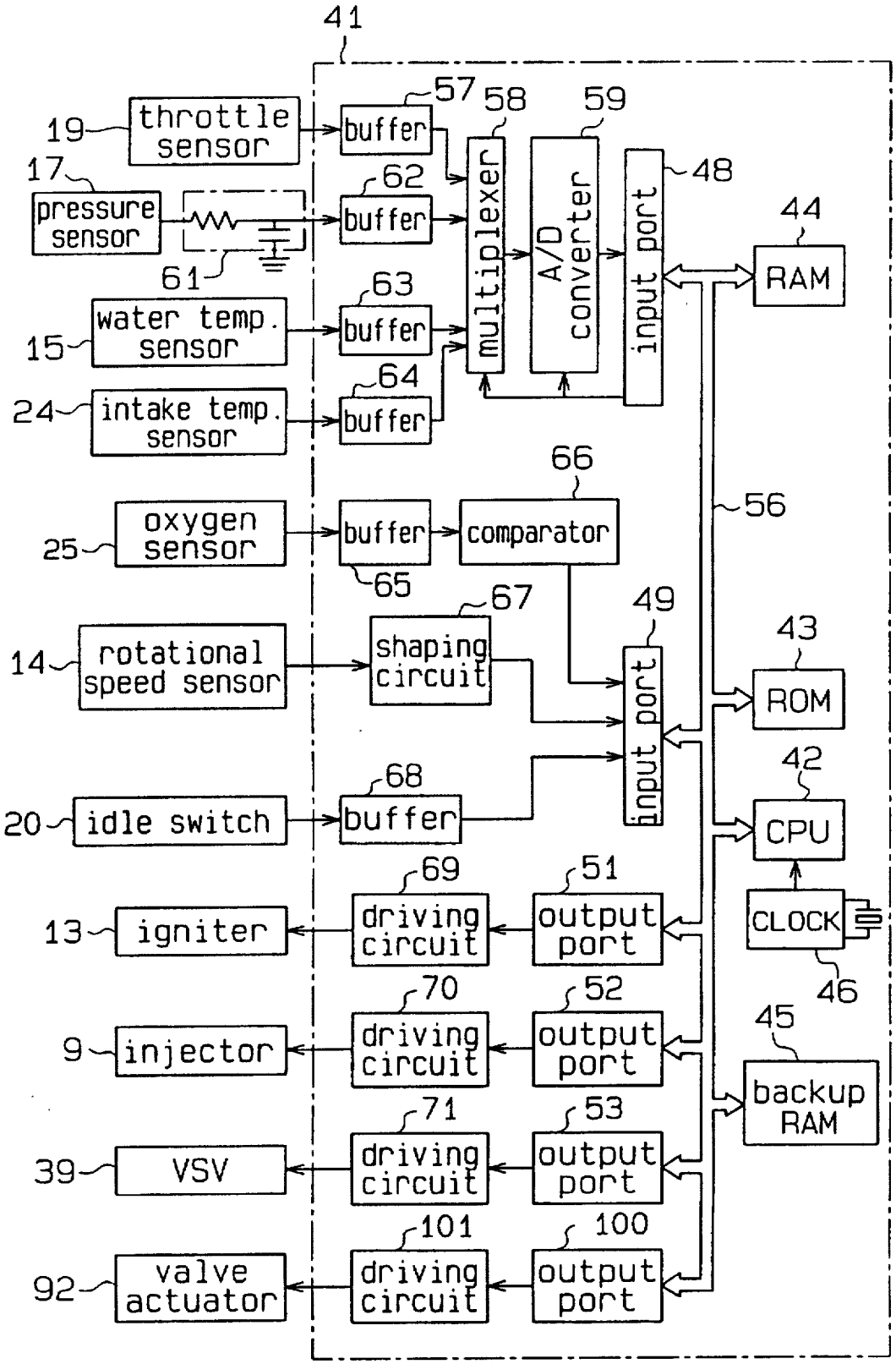
FIG. 17 is a block diagram showing the electrical components of an apparatus according to a fourth embodiment.

As shown in FIG. 17, the valve actuator 92 is connected to the CPU 42 via a bus 56, an output port 100 and a driving circuit 101. The CPU 42 controls the valve actuator 92 through the output port 100 and the driving circuit 101.

The operation of the fourth embodiment will now be described.

A routine for controlling the active mounts of FIG. 19 is executed during every predetermined cycle of operation, for example, once for every one revolution of the engine's drive shaft. Before commencing this routine, the CPU 42 reads the current concentration of purged fuel-vapor fgpg and the current duty ratio dpg.

In step 501, the CPU 42 judges whether the purge control permitting flag has a value "1", that is, the CPU 42 judges whether purging is taking place. If the purge permitting flag has a value "0", the CPU 42 moves to step 506. In step 506, the CPU 42 issues a valve open signal to the valve actuator 92. The valve actuator 92 opens the valve 91 in accordance with the valve close signal.

If the purge control permitting flag has a value "1" in step 501, the CPU 42 moves to step 502. In step 502, the CPU 42 judges whether the current concentration of purged fuel-vapor fgpg is equal to or less than the first reference value fgpg1. If the current purged fuel-vapor concentration fgpg is equal to or less than the first reference value fgpg1, the CPU 42 moves to step 506. If the current purged fuel-vapor concentration fgpg is greater than the first reference value fgpg1, the CPU 42 moves to step 503.

In step 503, the CPU 42 judges whether the current concentration of the purged fuel-vapor fgpg is equal to or more than the second reference value fgpg2. If the current purged fuel-vapor fgpg is equal to or more than the second reference value fgpg2, the CPU 42 moves to step 505. If the current purged-fuel concentration is less than the second reference value fgpg2, the CPU 42 moves to step 504.

In step 504, CPU 42 judges whether the duty ratio dpg is between the first duty ratio reference value dpg1 and the second duty ratio reference value dpg2. That is, the CPU 42 judges the values dpg, dpg1 and dpg2 satisfy the following inequality.

$$dpg1 \leqq dpg \leqq dpg2$$

If the duty ratio dpg is in the range between the first duty ratio reference value dpg1 and the second duty ratio reference value dpg2, the CPU 42 moves to step 505. If the duty ratio dpg is out of the range between the first duty ratio reference value dpg1 and the second duty ratio reference value dpg2, the CPU 42 moves to step 506.

The CPU 42 judges that torque fluctuations are great when the judgment result is "NO" in steps 502 and 503 and "YES" in step 504, or the judgment result is "YES" in step 503. That is, when the torque fluctuation is great, the following inequalities are satisfied.

$$fgpg1 < fgpg < fgpg2$$

$$dpg1 \leqq dpg \leqq dpg2$$

Alternatively, the following inequality is satisfied.

$$fgpg \geqq fgpg2$$

The above conditions are referred to as torque fluctuation judging conditions. Steps 502 and 503 function as torque fluctuation judging means using the purged fuel-vapor concentration. Step 504 functions as torque fluctuation judging means using duty ratio.

The CPU 42 judges that the torque fluctuation is small when the purging is judged not to be taking place in step 501, when the judgment result is "NO" in step 502, and when the judgment result is "NO" in step 504. That is, when the torque fluctuation is small, the following inequality is satisfied.

$$fgpg \leqq fgpg1$$

Alternatively, the following inequality is satisfied.

$$fgpg1 < fgpg < fgpg2$$

and the dpg is out of the range between dpg1 and dpg2.

Therefore, if the judgment result is "YES" in step 503, or "YES" in step 504, and the torque fluctuation is thus judged to be great, the CPU 42 outputs a close valve signal in step 505 and temporarily suspends the current routine. As a result, the valve 91 closes the communication hole 81*a* and thus prohibits liquid flow between the first and second liquid chambers 87*a* and 82*b*. Accordingly, the active control mounts have a higher spring rigidity, and lower damping characteristics. That is, the spring constant of the active control mount is changed to prevent resonance under the torque fluctuation frequency caused by purging.

If the judgment result "YES" in step 502, or "NO" in step 504, torque fluctuations are judged to be small. In this case, the CPU 42 outputs a valve open signal in step 506 and temporarily suspends the current routine. As a result, the valve 91 opens the communication hole 81*a* and thus permits liquid flow between the first and second liquid chambers 87*a* and 82*b*. Accordingly, the active control mounts have a low spring rigidity and high damping characteristics.

This embodiment has the following advantages.

During purge control, similar to the first embodiment, a frequency in the range F1, which is one of non-resonant frequency ranges, is selected as a non-resonant frequency Fvsv. Then, the VSV operational period is computed based on the non-resonant frequency Fvsv. The VSV 39 is operated at the computed VSV operational period.

During purge control, when the torque fluctuations are judged to be great, the valve 91 in the active control mount is closed as shown in FIG. 20. This shifts the resonance frequency to a higher frequency. Therefore, as shown in FIG. 20, the amplitude W of the engine vibration becomes half the amplitude 2W, which is the amplitude when the valve is opened. In this manner, disturbing vibrations caused by the resonance are eliminated.

A fifth embodiment of the present invention will now be described with reference to FIGS. 21 to 24.

In this embodiment, torque fluctuations (torque deviation) caused by large surges and violent idle vibrations are detected. Then the amount of purged fuel-vapor is decreased to suppress the surges and vibrations.

In addition to the electrical components of the first embodiment, the fifth embodiment includes a piezo-electric combustion pressure sensor 130 in each cylinder. The sensor 130 is located in the first cylinder. The effective compression work (indicated torque, which will be discussed later) during a compression stroke is detected based on the combustion pressure. A combustion pressure signal from the sensor 130 is inputted to the input port 48 via a buffer 101, the multiplexer 58, and analog-digital converter 59. The CPU 42 receives the combustion pressure signal.

In this embodiment, the same VSV operational period determining routine and VSV operation controlling routine employed in the first embodiment are executed.

Figure 24:
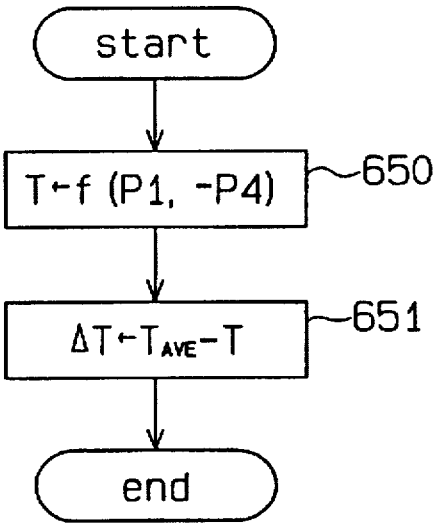
FIG. 24 is a flowchart showing a routine for computing engine torque deviation.

FIG. 24 is a flowchart of a torque deviation computing routine. This routine is executed at every given crank angle after the combustion stroke of the first cylinder, for example, at ninety degrees after the compression top dead center. In step 650, the CPU 42 computes the indicated torque T based on pressure values P1, P2, P3 and P4 shown in FIG. 23. The pressure values P1 to P4 corresponds to four different predetermined crank angles after the top dead center. In this embodiment, the indicated torque T is detected in accordance with the pressure values P1, P2, P3 and P4 by using a predetermined formula. Alternatively, the indicated torque itself may be computed.

In step 651, the CPU 42 computes the difference between the average torque value TAVE and the indicated torque T to obtain a torque deviation $\Delta Tq$. The CPU 42 stores $\Delta T$ in a predetermined area in the RAM 44, and temporarily suspends the current routine.

Figure 21:
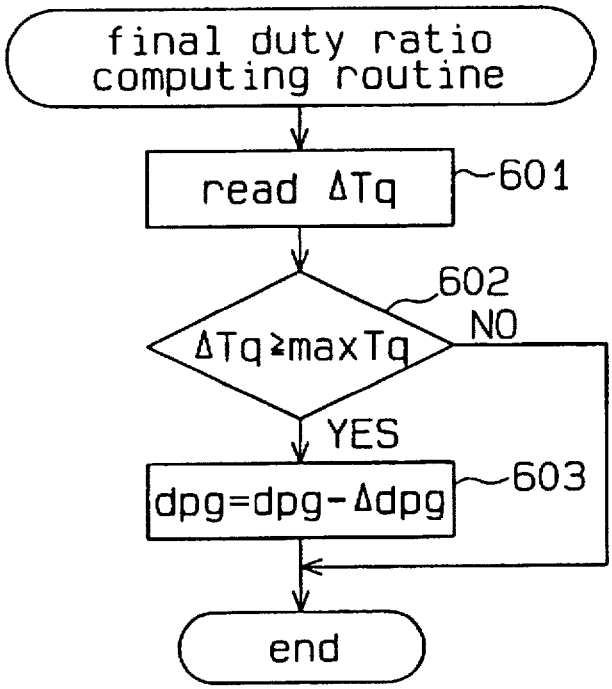
FIG. 21 is a flowchart showing a routine for computing a final duty ratio according to a fifth embodiment.
Figure 22:
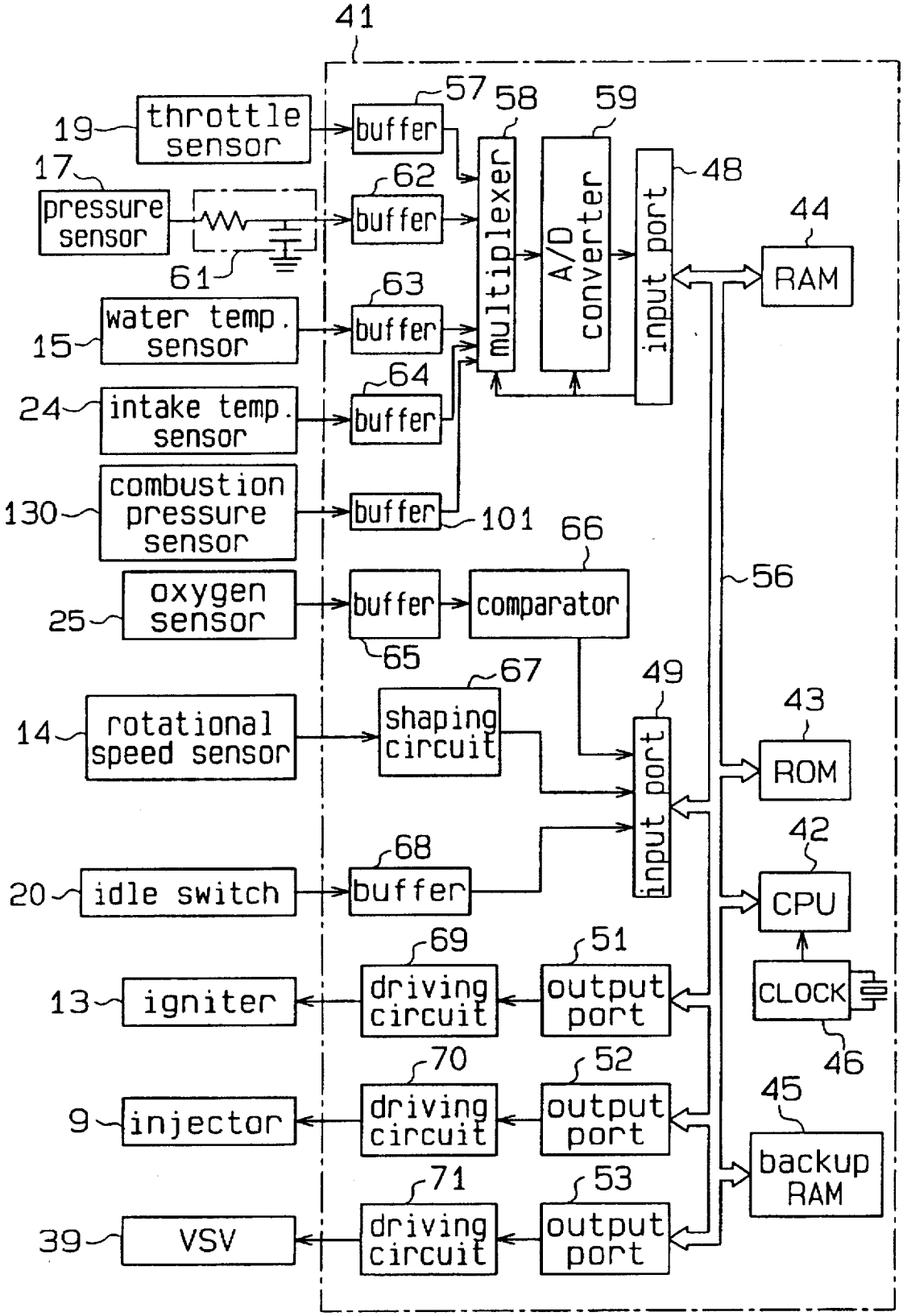
FIG. 22 is a block diagram showing the electrical components of an apparatus according to the fifth embodiment.
Figure 23:
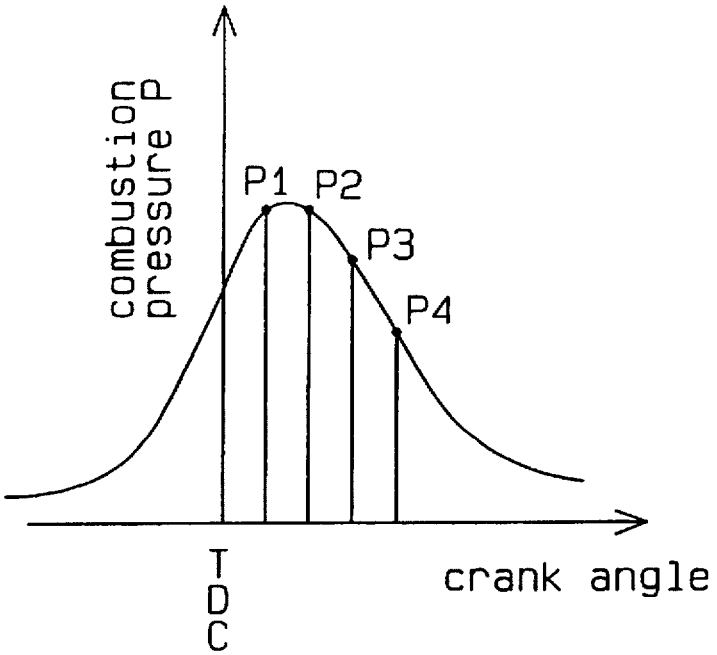
FIG. 23 is a graph showing the relationship between crank angle and combustion pressure in a combustion stroke.

FIG. 21 is a flowchart of a routine for computing a final duty ratio. This routine is executed at every predetermined timing. In step 601, the CPU 42 reads the torque deviation ΔTq, which is computed in the above described torque deviation computing routine. In step 602, the CPU 42 judges whether the torque deviation ΔTq is equal to or greater than a maximum allowance value maxTq. If the torque deviation ΔTq is less than the maximum allowance value maxTq, the CPU 42 judges that the torque deviation is small and temporarily suspends the current routine. The maximum allowance value maxTq is determined in accordance with the intake pressure PM and the engine speed NE. That is, the value maxTq is computed by using a two dimensional map (not shown), that has intake pressure PM and engine speed NE as parameters.

In step 602, if the torque deviation ΔTq is equal to or greater than the maximum allowance value maxTq, the CPU 42 judges that the torque deviation is great and moves to step 603. In step 603, the CPU 42 computes a final duty ratio of the VSV 39 by subtracting Δdpg from the duty ratio dpg of the VSV 39, which is computed in a different routine, and temporarily suspends the current routine. Step 602 functions as a second torque fluctuation judging means for judging whether the torque fluctuation is great.

The CPU 42 actuates the VSV 39 at predetermined times in accordance with the final duty ratio dpg. This opens the VSV 39 and the canister 34 is purged accordingly.

The fifth embodiment has the following advantages. In this embodiment, if the torque fluctuation (deviation) is equal to or less than a reference value, the CPU 42 judges that the torque fluctuation is great and decreases the amount of purged fuel-vapor. This reduces torque fluctuations, thereby suppressing surges.

A sixth embodiment of the present invention will now be described with reference to FIGS. 25 and 26.

In this embodiment, a torque deviation estimating routine is executed instead of the torque deviation computing routine of the fifth embodiment.

The concept behind the torque difference estimating routine will now be explained.

This method computes air-fuel ratio differences between each cylinder for estimating the toque deviation. In this embodiment, the fuel injection amount is computed by the following procedure. The fuel injection amount Tau, the basic injection amount TP and the fuel compensation amount by purging FPG satisfy the following equation:

$$Tau=TP\times(1-FPG)$$

In reality, since purged fuel-vapor forms an intermittent flow, some cylinders receive purged fuel-vapor and some cylinders do not receive purged fuel-vapor. It is assumed that the total amount of fuel drawn into the cylinders Mg, the purged fuel-vapor amount Mpg and the number of the cylinders N satisfy the following conditions.

(1) In a cylinder into which 100% of the purged fuel-vapor is drawn:

$$Mg=Tau+Mpg$$

The number of cylinders=Np (2) In a cylinder into which Rr % of the purged fuel-vapor is drawn:

$$Mg=Tau+Mpg\times Rr/100$$

The number of cylinders=NRr=1

(3) In a cylinder into which no purged fuel-vapor is drawn:

$$Mg=Tau$$

The number of cylinders=N−1−Np

The fuel richness ΔF of the cylinder into which 100% of purged fuel-vapor is drawn and the purged fuel-vapor compensation amount FPG satisfy the following equation (4):

$$\Delta F=FPG\times((N/(Np+NRr))-1) \quad (4)$$

Figure 26:
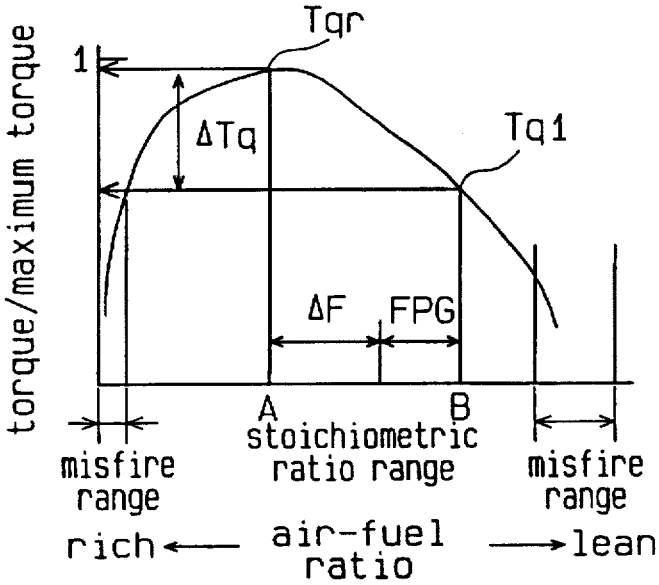
FIG. 26 is a graph showing the relationship between air-fuel ratio and engine torque.

The relationship between the ratio of the torque to the maximum torque and the air-fuel ratio is illustrated by the graph of FIG. 26. Therefore, the torque deviation ΔTq between a cylinder A, which draws no purged fuel-vapor, and a cylinder B, which draws purged fuel-vapor, is estimated. In the graph of FIG. 26, misfire ranges are located in the vicinity of the richest range and leanest range of air-fuel ratio.

Figure 25:
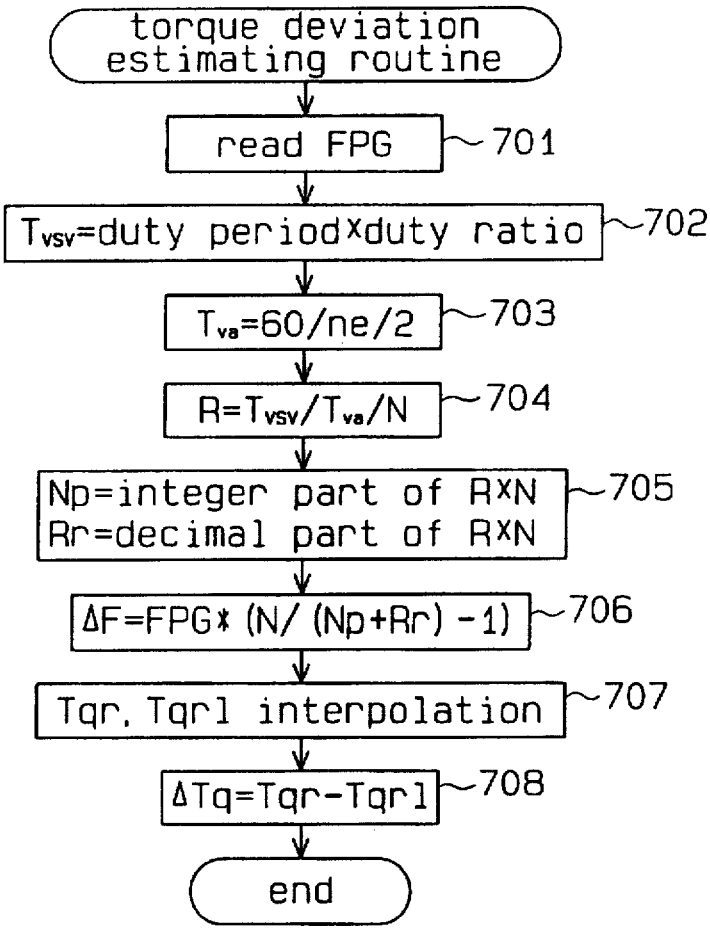
FIG. 25 is a flowchart showing a routine for estimating engine torque deviation.

FIG. 25 is the flowchart of a routine for estimating torque deviation. The CPU 42 executes this routine at predetermined times. In step 701, the CPU 42 reads compensation amount of purged fuel-vapor FPG. As in the second embodiment, the purged fuel-vapor compensation amount FPG is computed while a routine for computing the purged fuel-vapor concentration is executed and is stored in a predetermined area in the RAM 44.

In step 702, the CPU 42 computes the opening time Tvsv of the VSV 39 by the following equation:

$$Tvsv=\text{duty period}\times\text{duty ratio}$$

In step 703, the CPU 42 computes the opening time Tva of the intake valve 7. The intake valve open time Tva in a cylinder is approximately the half the time required for a single rotation of the engine 1. Thus Tva is computed by the following equation:

$$Tva=(60/NE)\times(1/2)$$

In step 704, the CPU 42 computes the ratio of the cylinder R, into which purged fuel-vapor is drawn, by the following equation:

$$R=(Tvsv/Tva)\times 1/N$$

In step 705, the CPU 42 computes the number of cylinders into which 100% of purged fuel-vapor is drawn, and the number of cylinders into which Rr % of purged fuel-vapor is drawn. In this case Np is the integer portion of R×N, and NRr is the decimal portion of R×N.

In step 706, the CPU 42 computes the deviation (richness) ΔF of the air-fuel ratio from the stoichiometric ratio in the cylinders into which purged vapor fuel is drawn by the above described equation (4). In step 707, the CPU 42 performs an interpolation operation for computing a torque deviation Tqr in a richer air-fuel ratio range and a torque deviation Tql in a leaner air-fuel ratio range by referring to the map of FIG. 26 having air-fuel ratio as a parameter. The map of FIG. 26 is obtained through experiments and previously stored in the ROM 43. In step 708, the CPU 42 computes the difference between the torque deviation Tqr in the richer air-fuel ratio range and the torque deviation Tql in the leaner air-fuel ratio range, thereby obtaining the torque deviation ΔTq and temporarily suspends the current routine.

Subsequently, the CPU 42 executes the final duty ratio computing routine as in the fifth embodiment. The CPU 42 actuates the VSV 39 at predetermined times in accordance with the final duty ratio dpg. This opens the VSV 39 and the canister 34 is purged, accordingly.

As described above, this embodiment reduces the amount of purged fuel-vapor for reducing torque fluctuations, thereby suppressing surges.

Although only six embodiments of the present invention have been described above, it should be apparent to those skilled in the art that the present invention may be embodied in many other specific forms without departing from the sprit or scope of the invention. Particularly, the invention may be embodied in the following forms:

In the first embodiment, a frequency in the range F1 is selected as the non-resonant frequency Fvsv. However, a frequency in the range F2 or the range F3 may be selected as the non-resonant frequency Fvsv.

In the above embodiments, a vacuum switching valve 39 is used. However, other type of valve may be used so long as it can be subjected to duty control.

Therefore, the present examples and embodiments are to be considered as illustrative and not restrictive and the invention is not to be limited to the details given herein, but may be modified within the scope of the appended claims.

What is claimed is:

1. A fuel-vapor emission control apparatus mounted on a vehicle having an internal combustion engine and a fuel tank, wherein said engine has a cylinder and is supported by mounting means, and wherein said fuel-vapor emission control apparatus purges fuel-vapor from said fuel tank and supplies the purged fuel-vapor to said engine, said fuel-vapor emission control apparatus comprising:

a purge control valve for controlling the amount of purged fuel-vapor that is supplied to said engine, an operating state detector for detecting the operating state of said engine, a valve controller for subjecting said purge control valve to duty control in accordance with data from said operating state detector, and suppressing means for suppressing resonance of said engine and said mounting means when purged fuel-vapor is being supplied to said engine.

2. The apparatus according to claim 1, further comprising a storing device for storing the fuel-vapor before the fuel vapor is supplied to the engine.

3. The apparatus according to claim 2, wherein said storing device comprises a canister.

4. The apparatus according to claim 1, wherein said suppressing means controls the period of purging for suppressing resonance of said engine and said mounting means.

5. The apparatus according to claim 4, wherein said suppressing means comprises a controller for controlling the period of purging based on a non-resonant frequency, which is located outside of a resonance frequency range of said mounting means.

6. The apparatus according to claim 1, wherein said suppressing means comprises an isolation controller for controlling the vibration isolation characteristics of said mounting means such that vibration of said engine remains outside of a resonance frequency range of said mounting means, and wherein said isolation controller is controlled in accordance with torque fluctuations of said engine.

7. The apparatus according to claim 6, wherein said suppressing means comprises a fluctuation detector for detecting torque fluctuations of said engine based on at least one of the concentration of purged fuel-vapor and the duty ratio of said purge control valve, and wherein said isolation controller is controlled based on torque fluctuations of said engine detected by said fluctuation detector.

8. The apparatus according to claim 6, wherein said mounting means comprises a rubber vibration insulator.

9. The apparatus according to claim 6, wherein said mounting means comprises an active control mount.

10. The apparatus according to claim 1, wherein a transmission is mounted on said mounting means with said engine.

11. A fuel-vapor emission control apparatus mounted on a vehicle having an internal combustion engine, a fuel tank, an air-fuel ratio detector, and injection compensation means, wherein said engine has a cylinder and is supported by mounting means, and wherein said fuel-vapor emission control apparatus purges fuel-vapor from said fuel tank and supplies the purged fuel-vapor to said engine, and wherein said air-fuel ratio detector detects the air-fuel ratio in said engine, and said injection compensation means adjusts a fuel injection amount by adding a feedback compensation coefficient to the fuel injection amount for causing the detected air-fuel ratio to approach a target air-fuel ratio, said fuel-vapor emission control apparatus comprising:

a purge control valve for controlling the amount of purged fuel-vapor that is supplied to said engine, an operating state detector for detecting the operating state of said engine, a valve controller for subjecting said purge control valve to duty control in accordance with data from said operating state detector, a concentration detector for detecting the concentration of purged fuel-vapor based on the difference between a feedback compensation coefficient before a purge and a feedback compensation coefficient after the purge, and wherein the operational frequency of said purge control valve is controlled in accordance with the detected concentration of purged fuel-vapor such that the operational frequency of said purge control valve remains outside of a resonance frequency range of said mounting means.

12. The apparatus according to claim 11, further comprising a storing device for storing the fuel-vapor before the fuel vapor is supplied to the engine.

13. The apparatus according to claim 11, wherein said mounting means comprises a rubber vibration insulator.

14. The apparatus according to claim 11, wherein said mounting means comprises an active control mount.

15. The apparatus according to claim 11, wherein a transmission is mounted on said mounting means with said engine.

16. A fuel-vapor emission control apparatus mounted on a vehicle having an internal combustion engine, a fuel tank, an air-fuel ratio detector, and injection compensation means, wherein said engine has a cylinder and is supported by mounting means, and wherein said fuel-vapor emission control apparatus purges fuel-vapor from said fuel tank and supplies the purged fuel-vapor to said engine, and wherein said air-fuel ratio detector detects the air-fuel ratio in said engine, and said injection compensation means adjusts a fuel injection amount by adding a feedback compensation coefficient to the fuel injection amount for causing the detected air-fuel ratio to approach a target air-fuel ratio, said fuel-vapor emission control apparatus comprising:

a purge control valve for controlling the amount of purged fuel-vapor that is supplied to said engine, an operating state detector for detecting the operating state of said engine, a valve controller for subjecting said purge control valve to duty control in accordance with data from said operating state detector, a concentration detector for detecting the concentration of purged fuel-vapor based on the difference between a feedback compensation coefficient before a purge and a feedback compensation coefficient after the purge, and wherein the operational frequency of said purge control valve is controlled in accordance with the detected concentration of purged fuel-vapor and the duty ratio of said purge control valve such that the operational frequency of said purge control valve remains outside of a resonance frequency range of said mounting means.

17. The apparatus according to claim 16, further comprising a storing device for storing the fuel-vapor before the fuel vapor is supplied to the engine.

18. The apparatus according to claim 16, wherein said mounting means comprises a rubber vibration insulator.

19. The apparatus according to claim 16, wherein said mounting means comprises an active control mount.

20. The apparatus according to claim 16, wherein a transmission is mounted on said mounting means with said engine.

* * * * *